US009937637B1

(12) United States Patent
Marsh

(10) Patent No.: US 9,937,637 B1
(45) Date of Patent: Apr. 10, 2018

(54) MOBILE MIXING APPARATUS WITH ADJUSTABLE MIXING PADDLES

(71) Applicant: William C. Marsh, Redding, CA (US)

(72) Inventor: William C. Marsh, Redding, CA (US)

( * ) Notice: Subject to any disclaimer, the term of this patent is extended or adjusted under 35 U.S.C. 154(b) by 303 days.

(21) Appl. No.: 15/009,734

(22) Filed: Jan. 28, 2016

Related U.S. Application Data

(60) Provisional application No. 62/110,556, filed on Feb. 1, 2015.

(51) Int. Cl.
*B01F 7/20* (2006.01)
*B28C 5/42* (2006.01)

(52) U.S. Cl.
CPC ..... *B28C 5/4289* (2013.01); *B01F 7/20* (2013.01)

(58) Field of Classification Search
CPC ..... B01F 7/20
USPC ..... 366/65, 192, 193, 312–314, 603
See application file for complete search history.

(56) References Cited

U.S. PATENT DOCUMENTS 2,594,236 A 4/1952 Wagner et al.
3,655,168 A 4/1972 Lord
3,731,909 A 5/1973 Johnson
5,474,379 A 12/1995 Perry
2001/0038573 A1* 11/2001 Knight ..... A01K 5/004 366/141
2002/0021618 A1* 2/2002 Joranlien ..... A01K 5/004 366/141
2002/0071338 A1* 6/2002 Knight ..... A01K 5/004 366/141
2003/0235109 A1* 12/2003 Knight ..... A01K 5/004 366/314
2004/0136264 A1* 7/2004 Albright ..... A01K 5/004 366/322
2005/0036402 A1* 2/2005 Knight ..... A01K 5/004 366/314

* cited by examiner

*Primary Examiner* — David Sorkin
(74) *Attorney, Agent, or Firm* — Jerry Haynes Law

(57) ABSTRACT

A mobile mixing apparatus for ensuring optimal mixing of a material includes a support member which is mobile on a support surface. A mixing drum is carried by the support member. The mixing drum has a base drum end, a side drum wall extending from the base drum end, an open drum end opposite the base drum end, a drum interior extending between the base drum end and the open drum end, a central inner surface and a base inner surface on the base drum end and a side inner surface on the side drum wall and facing the drum interior. A paddle assembly is disposed for rotation in the drum interior of the mixing drum. The paddle assembly includes a plurality of paddles engaging the central inner surface, the base inner surface and the side inner surface, respectively, of the mixing drum. At least one motor drivingly engages the paddle assembly for rotation in the drum interior of the mixing drum.

19 Claims, 21 Drawing Sheets

MOBILE MIXING APPARATUS WITH ADJUSTABLE MIXING PADDLES

CROSS-REFERENCE TO RELATED APPLICATIONS

This application claims the benefit of U.S. provisional application No. 62/110,556, filed Feb. 1, 2015 and entitled MOBILE MIXING APPARATUS WITH ADJUSTABLE MIXING PADDLES, which provisional application is hereby incorporated by reference herein in its entirety.

FIELD OF THE INVENTION

The present invention relates generally to a mobile mixing apparatus with adjustable mixing paddles. More so, the present invention relates to a mobile mixing apparatus having variously configured and oriented paddles for engaging an optimal inner surface area of a mixing drum to optimize removal of construction materials which adhere to the inner surface area of the mixing drum and mixing of the materials.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 12:
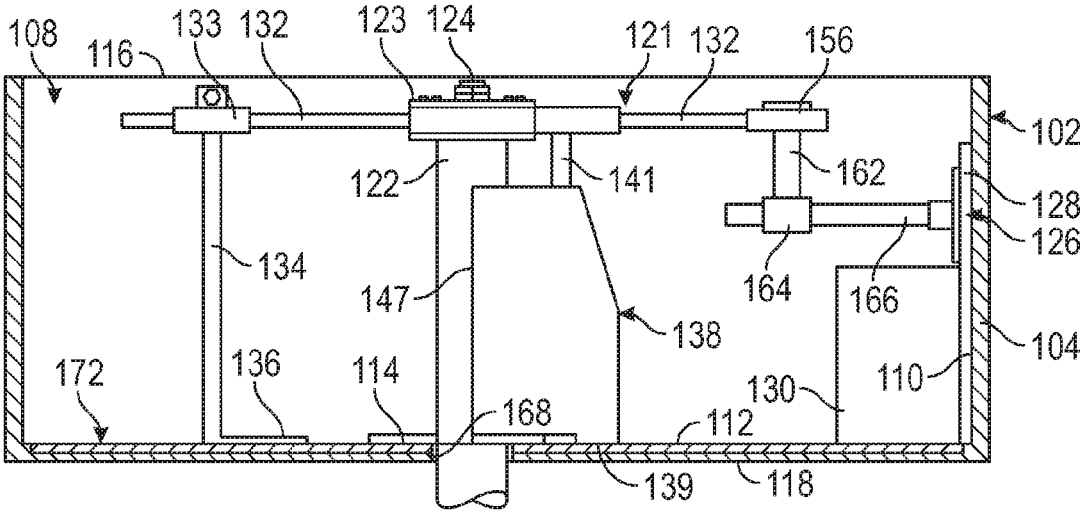
FIG. 12 is a cross-sectional view of the mixing drum and the paddle assembly in the drum interior of the mixing drum, illustrating a typical central paddle, base paddle and side paddle of the paddle assembly engaging the central inner surface, the base inner surface and the side inner surface, respectively, of the mixing drum.

An illustrative embodiment of a mobile mixing apparatus with adjustable paddles is generally indicated by reference numeral 100 in FIGS. 1-10B. The mobile mixing apparatus 100 may include a mixing drum 102. As illustrated in FIG. 12, the mixing drum 102 may include a base drum end 118 and a side drum wall 104 which extends from the base drum end 118. In some embodiments, the side drum wall 104 may be generally cylindrical. A drum interior 108 may be formed by the base drum end 118 and the side drum wall 104, and may have an open drum end 116 which is opposite the base drum end 118. The side drum wall 104 may have a side inner surface 110 which faces the drum interior 108. The base end 118 may have a base inner surface 112 and a central inner surface 114 (FIGS. 2 and 12) which face the drum interior 108. In typical application of the mobile mixing apparatus 100, which will be hereinafter described, the drum interior 108 of the mixing drum 102 may be configured to contain, mix and discharge construction materials (not illustrated) such as decomposed granite, cement, and binding compositions, for example and without limitation. The drum interior 108 may extend in a longitudinal direction between the open drum end 116 and the base drum end 118 of the mixing drum 102. In some embodiments, the area of the open drum end 116 may be about 80" wide×32" deep. In some embodiments, the drum interior 108 may be tapered down from the open drum end 116 to the base drum end 118. The depth of the drum interior 108 in some embodiments may be about 6'.

Figure 2:
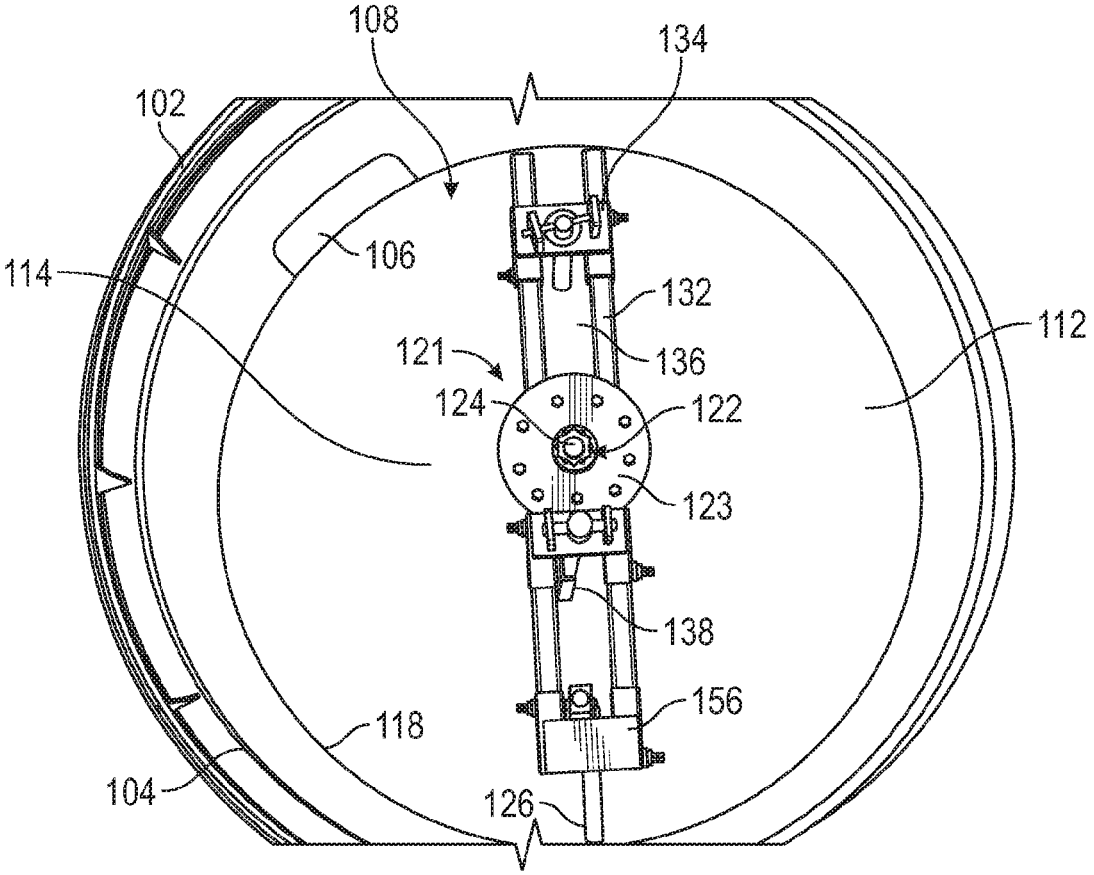
FIG. 2 illustrates a top view of an exemplary mixing drum of the mobile mixing apparatus, in accordance with an illustrative embodiment of the present invention.
Figure 3:
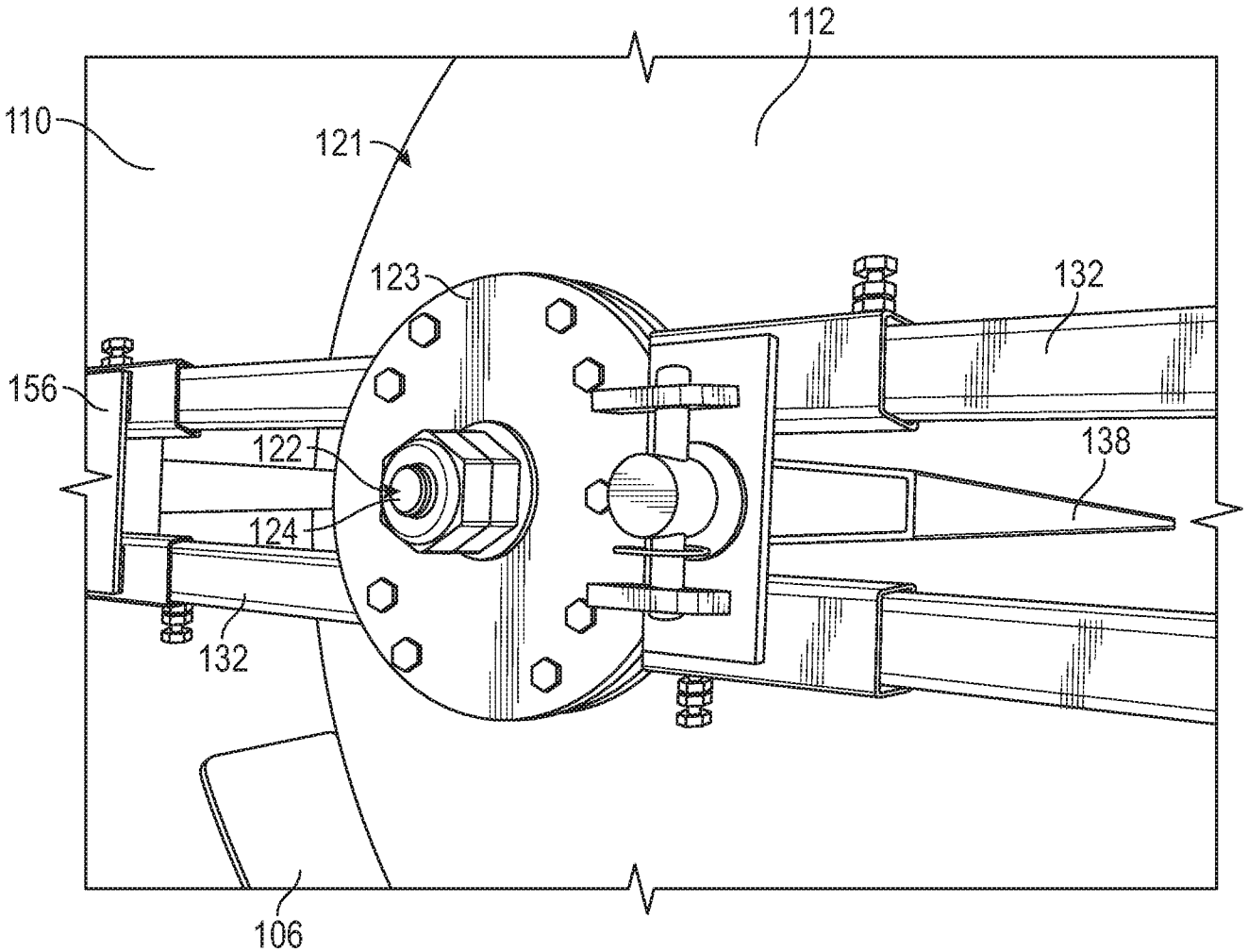
FIG. 3 illustrates a top perspective view of an exemplary paddle assembly of the mobile mixing apparatus, in accordance with an illustrative embodiment of the present invention.
Figure 4:
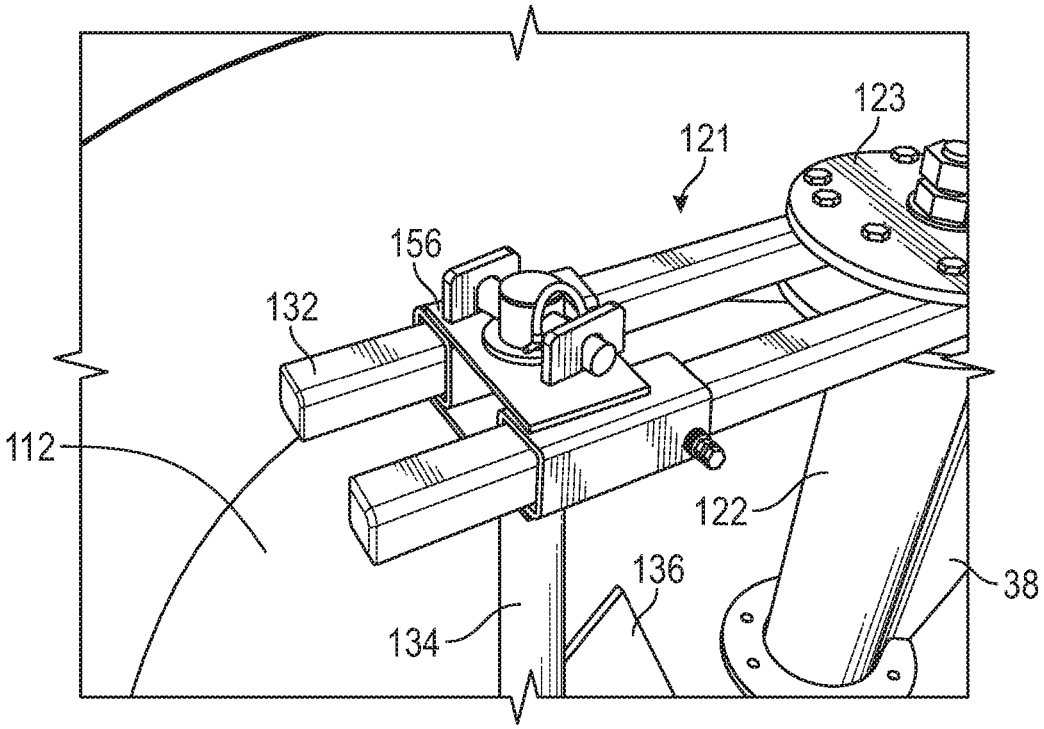
FIG. 4 illustrates a top perspective view of a portion of an exemplary base paddle on the paddle assembly of the mobile mixing apparatus, in accordance with an illustrative embodiment of the present invention.
Figure 5:
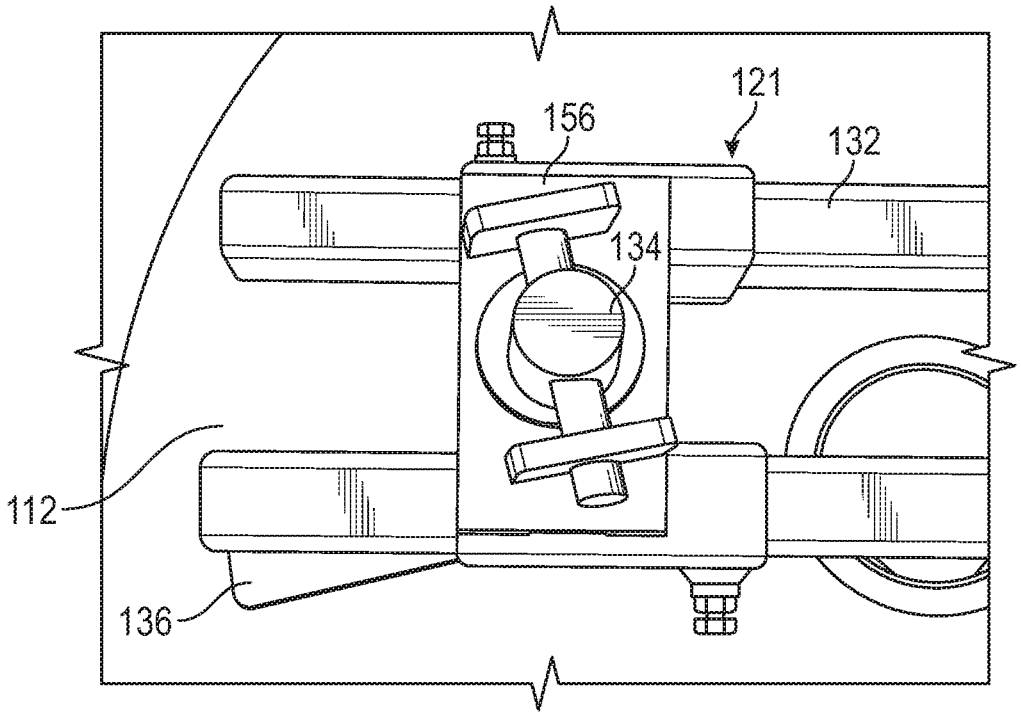
FIG. 5 illustrates a top view of an exemplary junction bracket which attaches a base bar to a paddle adjustment bar of the paddle assembly of the mobile mixing apparatus, in accordance with an embodiment of the present invention.
Figure 6:
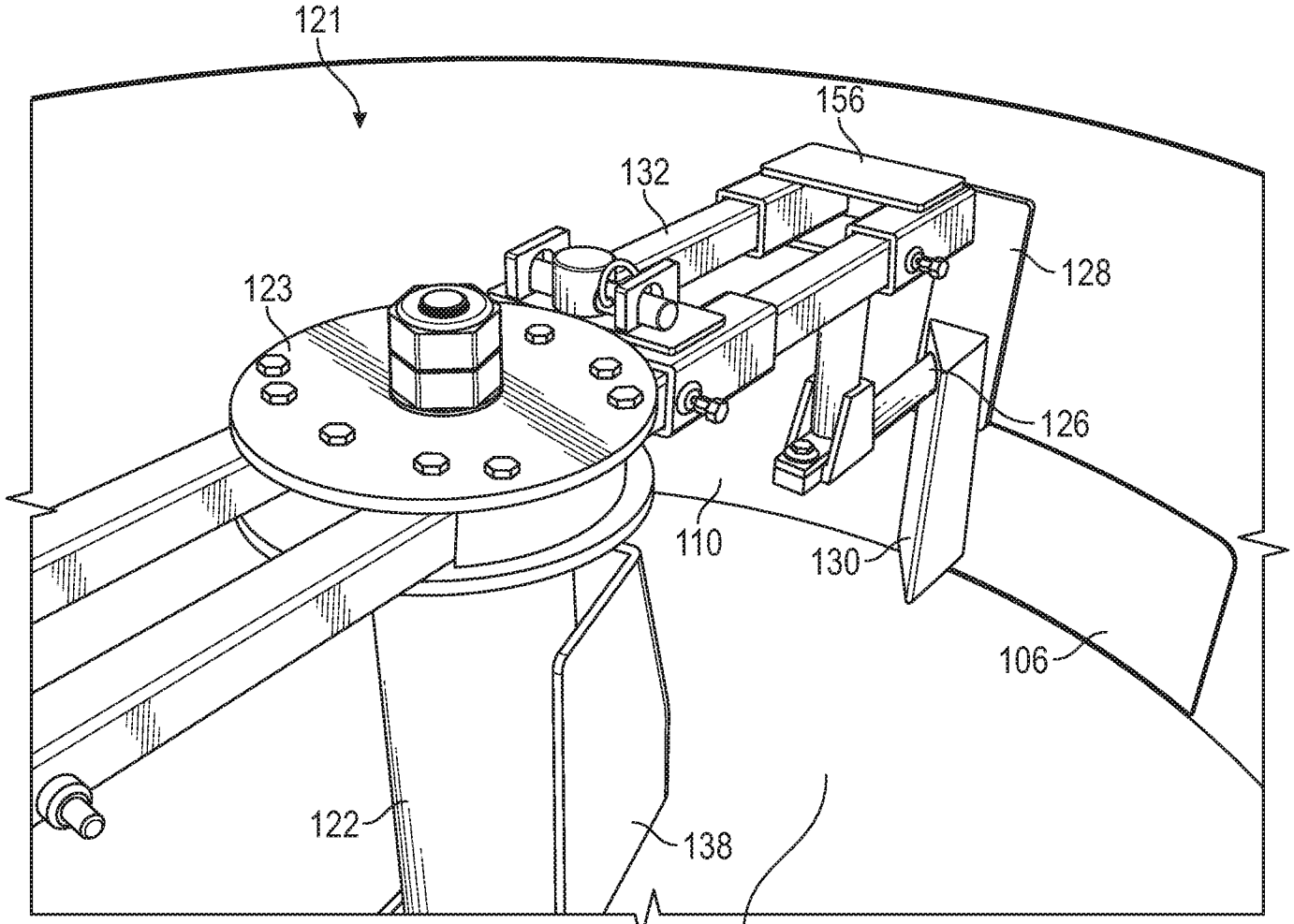
FIG. 6 illustrates a perspective side view of an exemplary central paddle and an exemplary side paddle of the paddle assembly on the mobile mixing apparatus, in accordance with an embodiment of the present invention.
Figure 7:
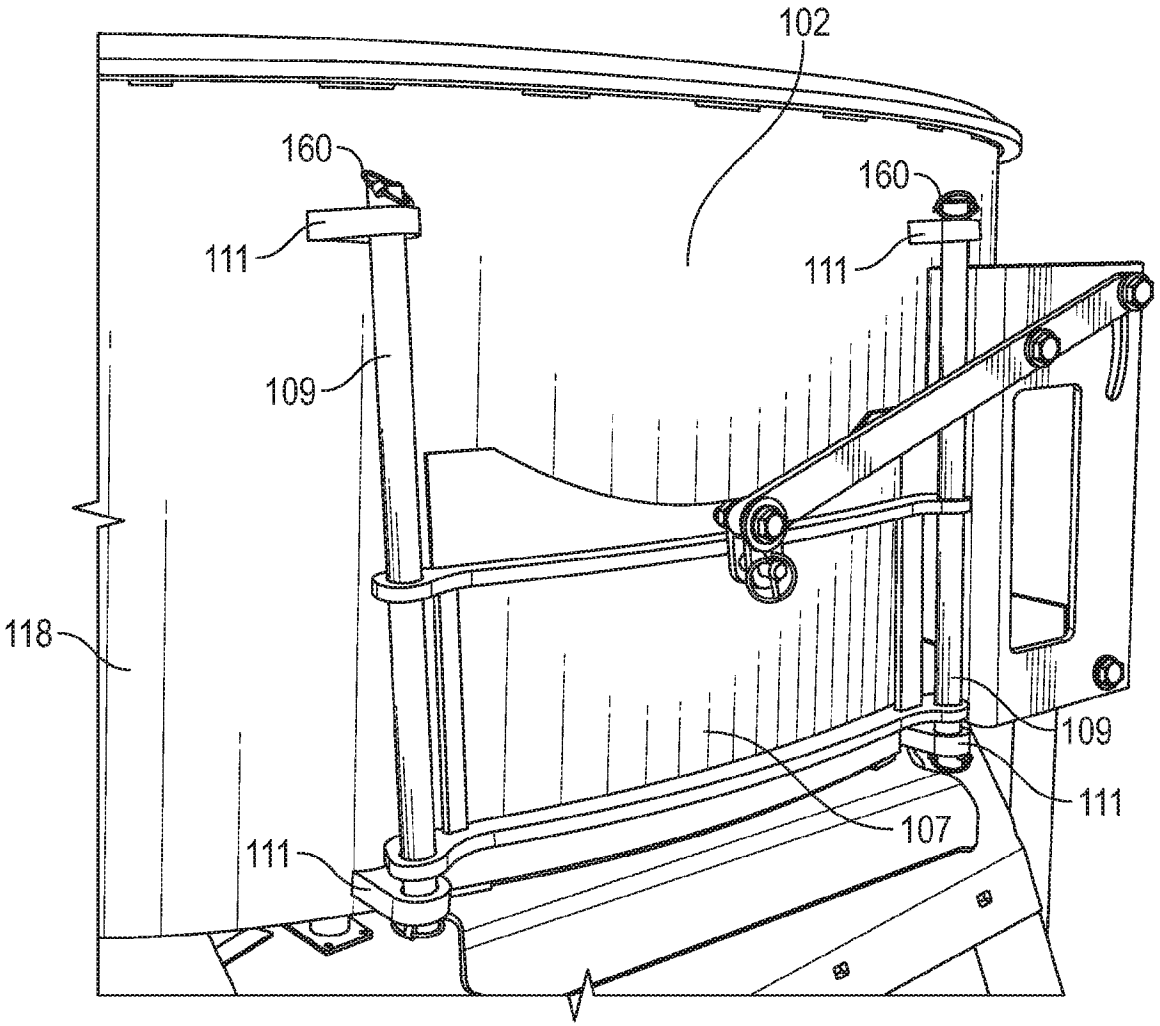
FIG. 7 illustrates a perspective view of an exemplary drum outlet door on the mixing drum of the mobile mixing apparatus, in accordance with an illustrative embodiment of the present invention.

As illustrated in FIG. 2, a drum outlet 106 which communicates with the drum interior 108 may extend through the side drum wall 104 of the mixing drum 102. As illustrated in FIG. 7, in some possible embodiments, the drum outlet 106 (FIG. 2) may include a drum outlet door 107 that selectively moves between a closed position (FIG. 7) and an open position (not illustrated) to close and open, respectively, the drum outlet 106. The drum outlet door 107 of the drum outlet 106 may include, without limitation, a guillotine door, a detachable panel, and a valve. As further illustrated in FIG. 7, in some embodiments, the drum outlet door 107 may slide up and down on a door track 109. The door track 109 may include a pair of parallel, spaced-apart rods which are held between four track mount ears 111 that are welded, fastened and/or otherwise attached to the mixing drum 102. In some embodiments, quick pins 160 may secure the rods of the door track 109 in place in the track mount ears 111. Accordingly, by removal of the quick pins 160, the drum outlet door 107 may be configured for quick removal from the door track 109 for cleaning purposes, if necessary.

As further illustrated in FIGS. 2 and 12, a paddle assembly 121 may be disposed for rotation in the drum interior 108 of the mixing drum 102 for mixing the construction materials. The paddle assembly 121 may include a variously-configured and -oriented side paddle 126, base paddle 136 and central paddle 138 for engaging the maximum extent or area of the side inner surface 110, the base inner surface 112 and the central inner surface 114, respectively, of the mixing drum 102.

The paddle assembly 121 may include a drive axle 122 which may be centrally-disposed in the drum interior 108. The drive axle 122 may have a first axle end 124 in the drum interior 108 and a second axle end 125 (FIG. 12). The drive axle 122 may extend through a drive axle opening 168 (FIG. 12) in the base drum end 118 of the mixing drum 102. At least one motor 146 (FIG. 1) may drivingly engage the drive axle 122, typically at the second axle end 125, for rotation according to the knowledge of those skilled in the art.

Figure 12A:
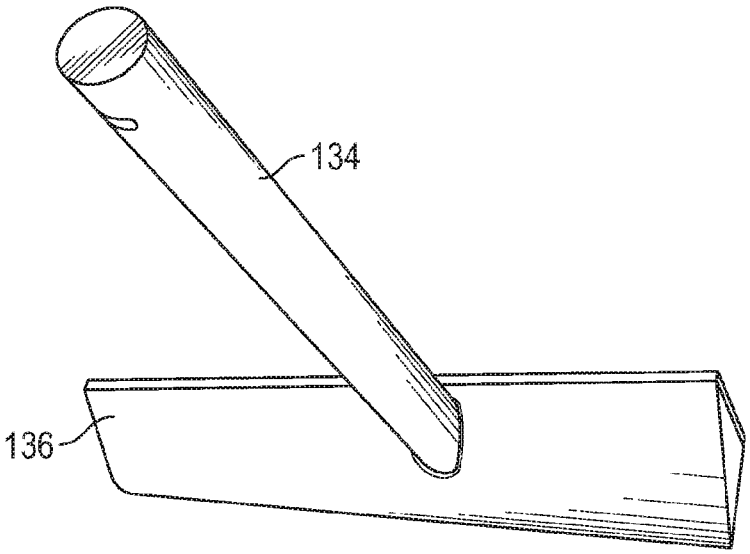
FIG. 12A is a top perspective view of an exemplary base paddle of the paddle assembly.
Figure 12B:
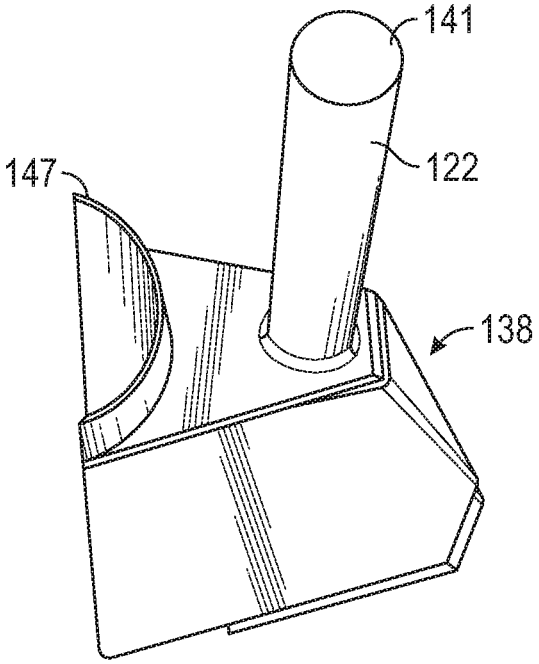
FIG. 12B is a top perspective view of an exemplary central paddle of the paddle assembly.

The central paddle 138 of the paddle assembly 121 may extend from the drive axle 122. In some embodiments, the central paddle 138 may be supported in a fixed relation to the drive axle 122, extending generally radially therefrom. As illustrated in FIG. 12B, an axle cradle 147 may be provided on the central paddle 138. As illustrated in FIG. 12, the axle cradle 147 may accommodate the drive axle 122. A central paddle support member 141 may extend from the central paddle 138. The central paddle support member 141 may be attached to the drive hub 123 of the drive axle 122 according to the knowledge of those skilled in the art. Accordingly, responsive to operation of the at least one motor 146 (FIG. 1), the central paddle 138 may rotate with the drive axle 122. The central paddle 138 may include a central paddle lower edge 139 which engages the central inner surface 114 of the mixing drum 102. Thus, the central paddle lower edge 139 may engage the central inner surface 114 in a circular path to scrape and remove the construction materials which adhere to the central inner surface 114 during mixing of the construction materials in the drum interior 108.

The drive axle 122 may drivingly engage a drive hub 123 for rotation, typically at the first axle end 124. The drive hub 123 may drivingly engage at least one elongated paddle adjustment bar 132 for rotation in the drum interior 108. The at least one paddle adjustment bar 132 may be coupled to the drive hub 123 according to the knowledge of those skilled in the art. The respective ends of the at least one paddle adjustment bar 132 may be disposed at 180 degrees with respect to each other on opposite sides of the drive hub 123.

The at least one paddle adjustment bar 132 may drivingly engage the side paddle 126 and the base paddle 136 for rotation in the drum interior 108 according to the knowledge of those skilled in the art. Accordingly, as particularly illustrated in FIG. 12, in some embodiments, a base paddle junction bracket 133 and a side paddle junction bracket 156 may be provided on the at least one paddle adjustment bar 132 on opposite sides of the drive hub 123. A base bar 134 may extend downwardly from the base paddle junction bracket 133. As illustrated in FIG. 12A, the base paddle 136 may extend from the base bar 134. Accordingly, the base paddle 136 may engage an inner portion of the base inner surface 112 in a circular path to scrape and remove the construction materials which adhere to the inner portion of the base inner surface 112 during mixing of the construction materials in the drum interior 108. The base paddle 136 may have a generally planar shape which is oriented generally coplanar to the base inner surface 112. Thus, the base paddle 136 may rest flush against the base inner surface 112. In some embodiments, the base paddle 136 may take the shape of a right triangle with a taper to the outside so that it directs the mix in that direction upon rotation of the paddle assembly 121.

The base paddle 136 may be supported in an adjustable relation to the paddle adjustment bar 132 with the base bar 134 vertically adjustably mounted with respect to the base paddle junction bracket 133. The base paddle junction bracket 133 may be configured to adjustably traverse the length of the paddle adjustment bar 132 in radial relationship to the drive hub 123. The base bar 134 may be configured to rotate in relation to the base paddle junction bracket 133. The base bar 134 may be fastened into a desired orientation with respect to the base paddle junction bracket 133 through a bolt or other fastening mechanism (not illustrated). In some embodiments, the base bar 134 may be oriented vertically, parallel to the longitudinal axis of the drum.

Figure 12C:
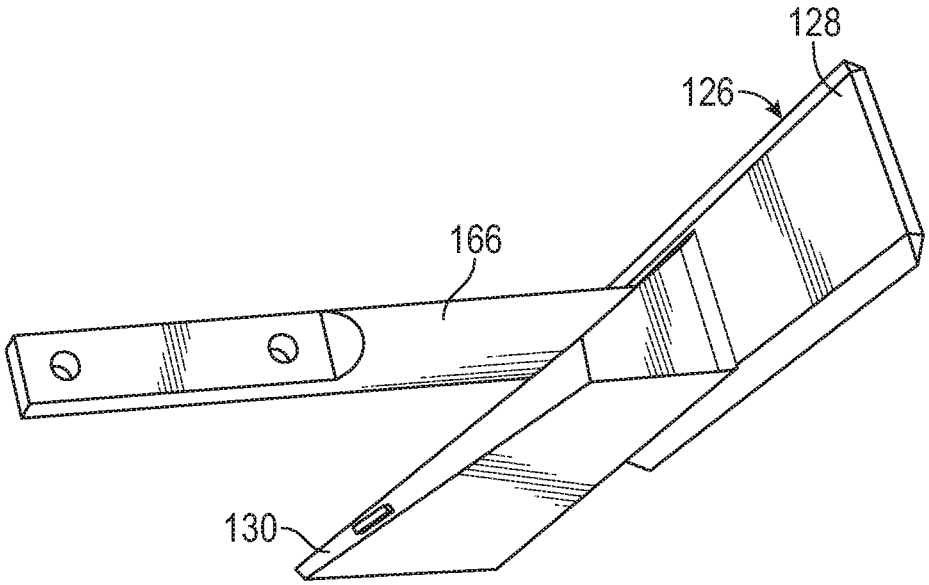
FIG. 12C is a top perspective view of an exemplary side paddle of the paddle assembly.

As further illustrated in FIG. 12, in some embodiments, a descending paddle arm 162 may extend downwardly from the side paddle junction bracket 156. A paddle arm bracket 164 may be provided on the descending paddle arm 162. A transverse paddle arm 166 may extend horizontally from the paddle arm bracket 164. The side paddle 126 may terminate the transverse paddle arm 166. As illustrated in FIGS. 12 and 12C, the side paddle 126 may include a parallel paddle portion 128 which is generally parallel, and a perpendicular paddle portion 130 which is generally perpendicular, to the side drum wall 104 of the mixing drum 102. Accordingly, the parallel paddle portion 128 of the side paddle 126 may engage the side inner surface 110 in a circular path to scrape and remove the construction materials which adhere to the side inner surface 110 during mixing of the construction materials in the drum interior 108. In like manner, the perpendicular paddle portion 130 of the side paddle 126 may engage an outer portion of the base inner surface 112 in a circular path to scrape and remove the construction materials which adhere to the outer portion of the base inner surface 112 during mixing of the construction materials.

The side paddle 126, the base paddle 136 and the central paddle 138 may each be mounted for positional adjustment in the drum interior 108. For example and without limitation, in some embodiments, the central paddle 138 may be mounted on the drive axle 122 for selective horizontal and vertical adjustment with respect to the central inner surface 114 of the mixing drum 102 according to the knowledge of those skilled in the art. Likewise, the base paddle 136 may be mounted for selective horizontal adjustment with respect to the side drum wall 104 and selective vertical adjustment with respect to the base inner surface 112 according to the knowledge of those skilled in the art. For example and without limitation, in some embodiments, vertical adjustment of the base paddle 136 may be effected by sliding and securing the base bar 134 in the base paddle junction bracket 133.

The side paddle 126 may be mounted for selective horizontal adjustment with respect to the side drum wall 104 and selective vertical adjustment with respect to the base inner surface 112 of the mixing drum 102. In some embodiments, horizontal adjustment of the side paddle 126 may be effected by sliding and securing the transverse paddle arm 166 in the paddle arm bracket 164 using adjustable fastening techniques known by those skilled in the art. Vertical adjustment of the side paddle 126 may be effected by sliding and securing the descending paddle arm 162 in the side paddle junction bracket 156 using adjustable fastening techniques known by those skilled in the art.

In some embodiments, the side paddle 126 and/or the base paddle 136 may be selectively adjusted by loosening at least one bolt from the base paddle junction bracket 133 and/or the side paddle junction bracket 156. The bolts may be welded to the pair of parallel bars that form the at least one paddle adjustment bar 132 according to some embodiments of the paddle adjustment bar 132. The side paddle 126, the base paddle 136 and the central paddle 138 may be centered between the parallel bars of the at least one paddle adjustment bar 132.

Figure 1:
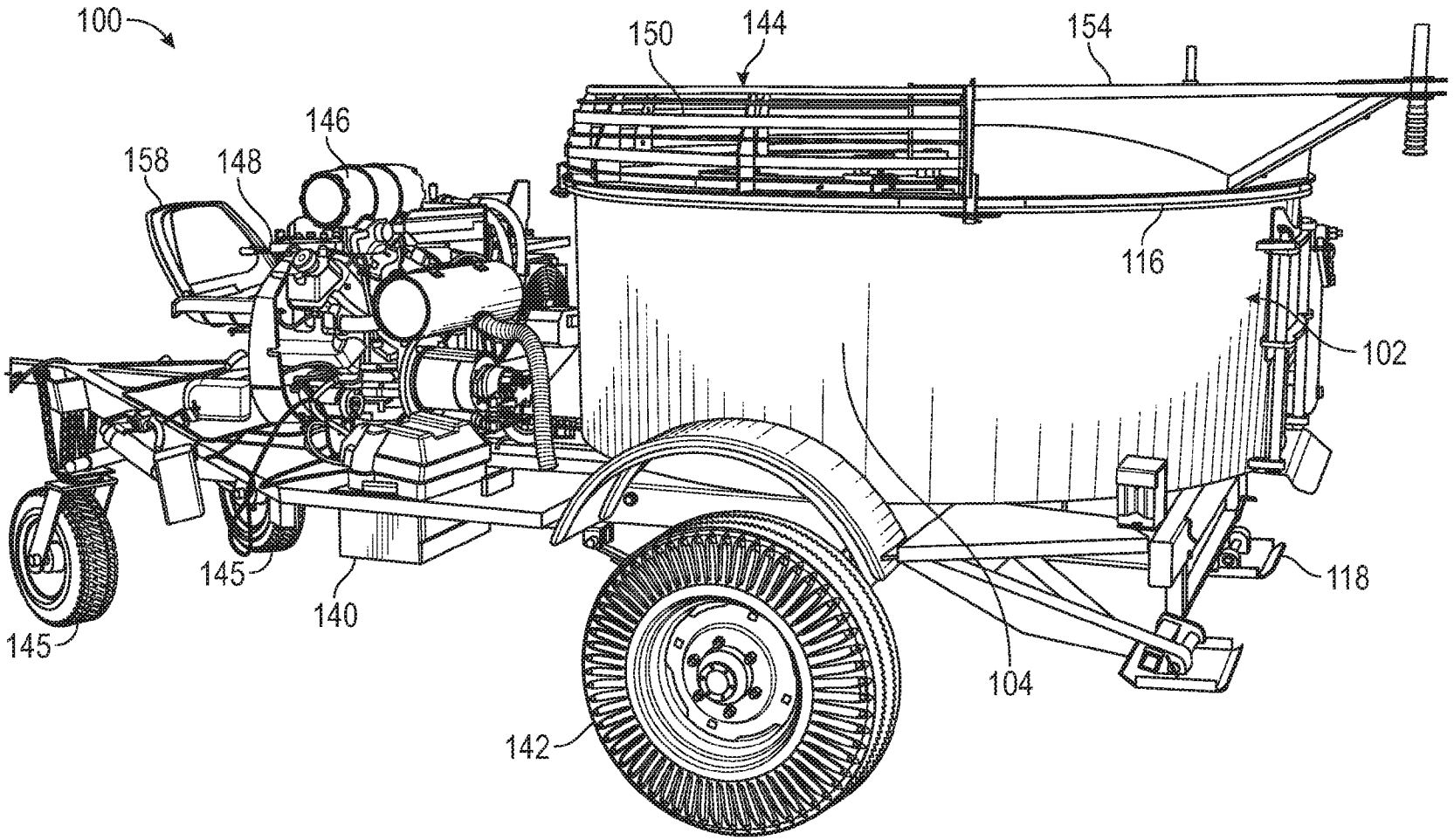
FIG. 1 illustrates a side perspective view of an exemplary mobile mixing apparatus, in accordance with an illustrative embodiment of the present invention.
Figure 9:
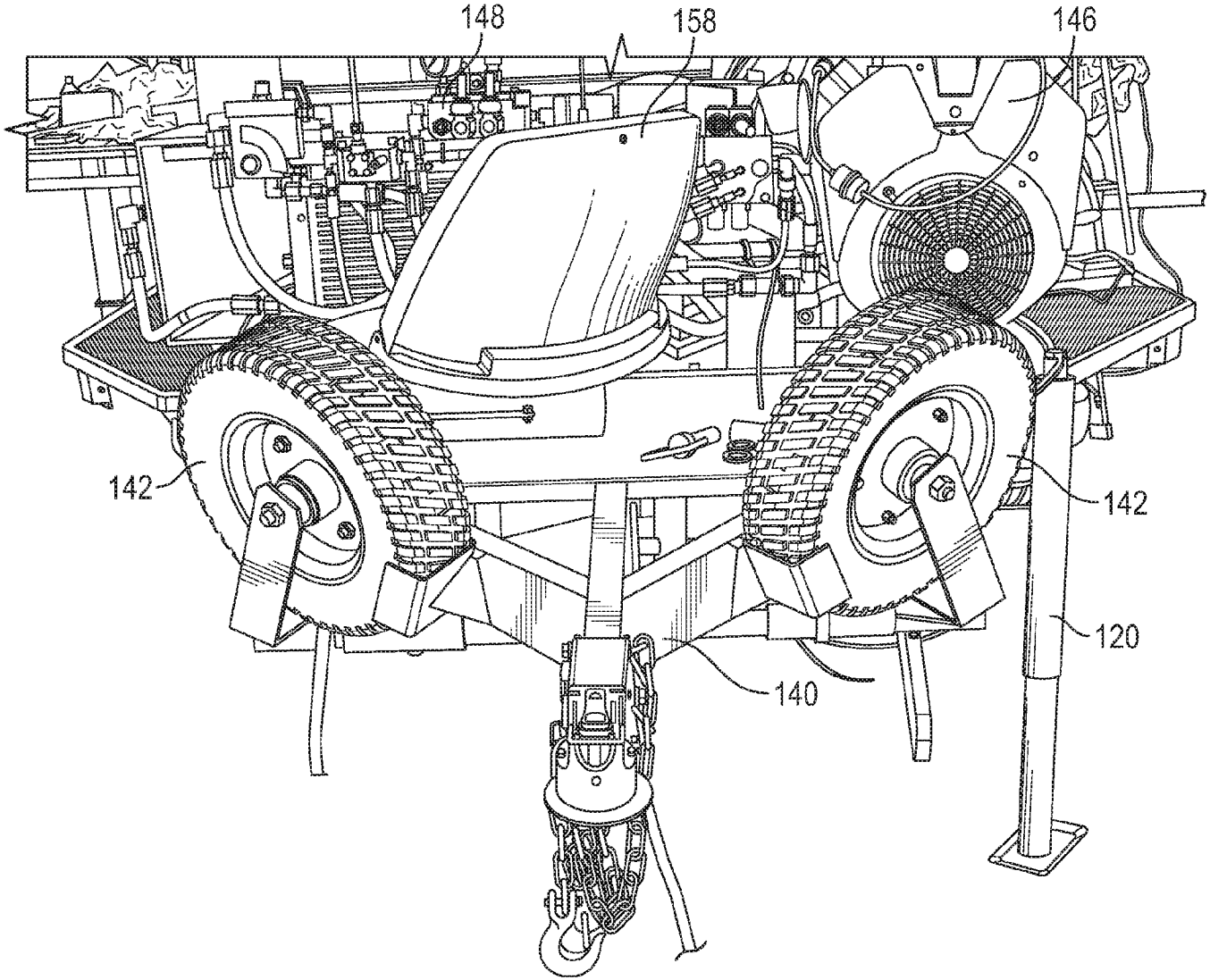
FIG. 9 illustrates a front view of an exemplary support member of the mobile mixing apparatus, in accordance with an illustrative embodiment of the present invention.
Figure 23:
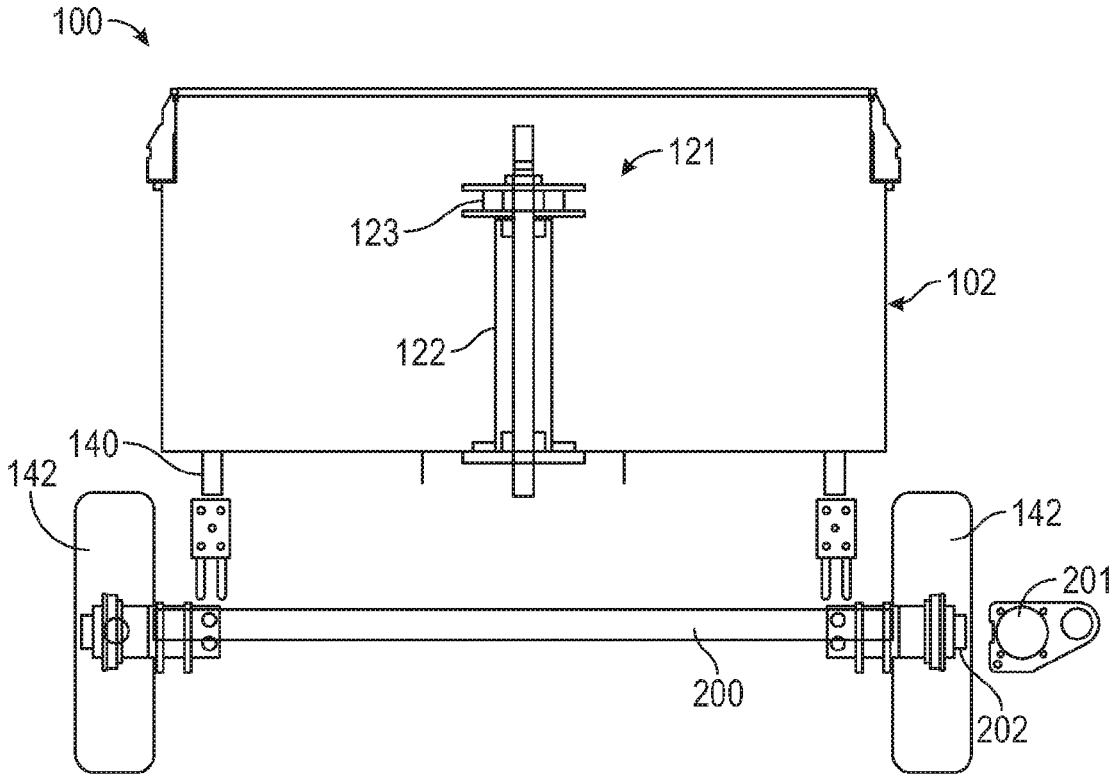
FIG. 23 is a front view of an exemplary mobile mixing apparatus, more particularly illustrating an exemplary drive axle trailer with the mixing drum on the drive axle trailer and an axle motor drivingly engaging the drive axle.
Figure 24:
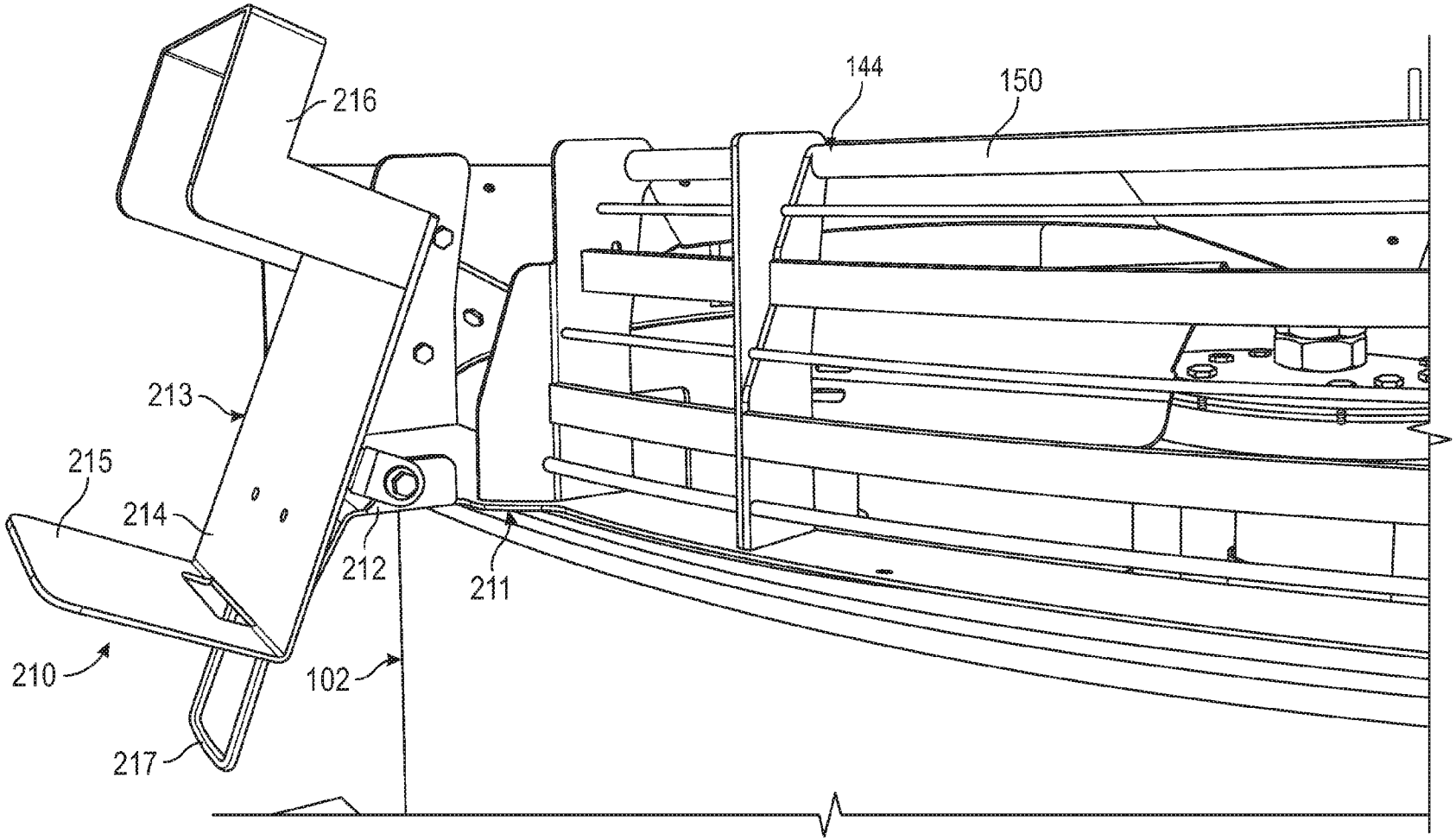
FIG. 24 is a perspective view of an exemplary dump container assembly on the mixing container according to some embodiments of the mobile mixing apparatus, with a container platform of the dump container assembly deployed in a lowered position.

As illustrated in FIG. 1, in some embodiments, a support member 140 may support and provide positional adjustment for the mixing drum 102. In some embodiments, the support member 140 may include a trailer which provides mobility for the mixing drum 102. The support member 140 may be fitted with main wheels 142. As illustrated in FIG. 9, at least one lifting device 120, such as a hydraulic jack, for example and without limitation, may be provided on the support member 140 to engage the ground or other support surface and selectively raise and lower the support member 140 on the support surface. The plurality of main wheels 142 may be able to retract into a stowed position when the at least one lifting device 120 is deployed. In some embodiments, the support member 140 may include at least one caster wheel 145 that adjustably locks when the support member 140 is lifted during mixing operations. As illustrated in FIG. 23, in some embodiments, at least one of the main wheels 142 may be fitted with a drive axle motor 201. The at least one motor 146 may be provided on the support member 140 and may drivingly engage the paddle assembly 121 for rotation in the drum interior 108, typically in a manner which will be hereinafter described. In some embodiments, the at least one motor 146 may drivingly engage the lifting device 120 according to the knowledge of those skilled in the art to provide general adjustability and mobility to the mobile mixing apparatus 100.

Figure 13:
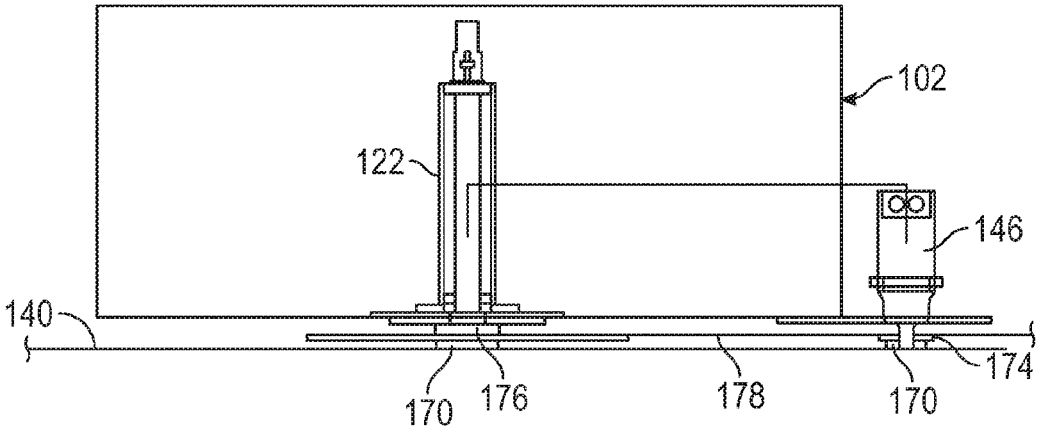
FIG. 13 is a side view of the mixing drum with a front load cell and a rear load cell on the support member and the mixing drum on the load cells, and further illustrating a hydraulic motor drivingly engaging the paddle assembly for rotation in accordance with some embodiments of the present invention.
Figure 14:
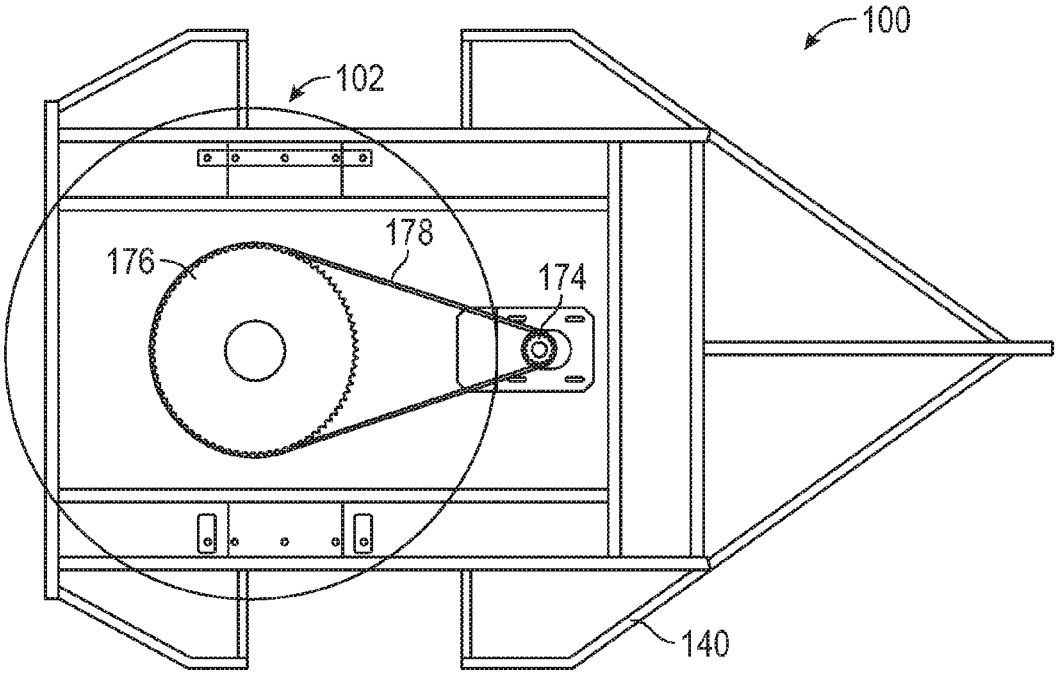
FIG. 14 is a bottom view of the exemplary mobile mixing apparatus, more particularly illustrating a typical drive arrangement for the mixing drum.
Figure 15:
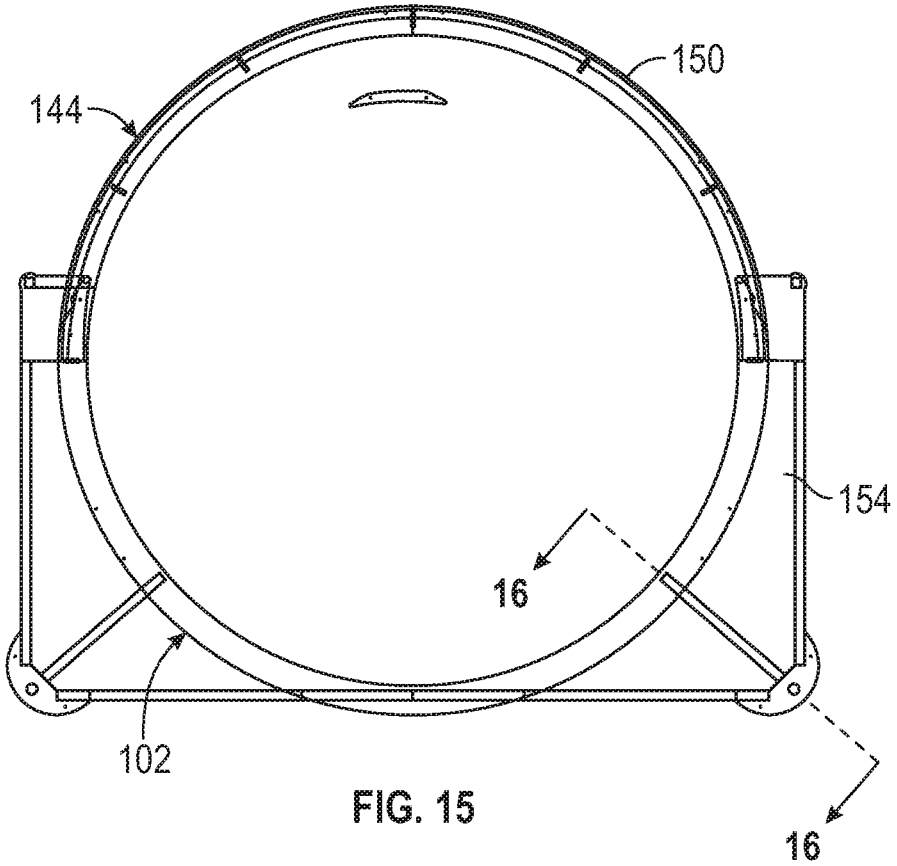
FIG. 15 is a top view of the mixing drum, with an exemplary guard assembly on the mixing drum.
Figure 16:
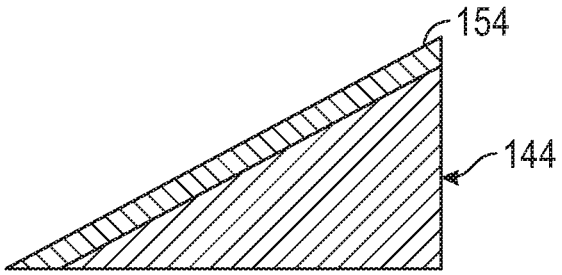
FIG. 16 is a sectional view of a portion of the chute hopper of the guard assembly, taken along section lines 16-16 in FIG. 15.

As illustrated in FIGS. 13 and 14, in some embodiments of the mobile mixing apparatus 100, at least one exterior load cell 170 may be provided on the support member 140. The at least one exterior load cell 170 may be operatively connected to the mixing drum 102 to weigh the contents of the mixing drum 102 for proper measurements of the construction materials being mixed. In some embodiments, a pair of front and rear exterior load cells 170 may be provided on the support member 140. A front hydraulic motor 146 may be welded, trussed and/or otherwise attached to the bottom of the mixing drum 102. A drive sprocket 174 may be drivingly engaged by the front hydraulic motor 146. A driven sprocket 176 may drivingly engage the drive axle 122 of the paddle assembly 121. A drive chain 178 may mesh with the drive sprocket 174 and the driven sprocket 176. The hydraulic motor 146 and drive sprocket 174 may drive the drive chain 178, which may, in turn, rotate the drive axle 122 of the paddle assembly 121. The exterior load cells 170 may support the mixing drum 102, the hydraulic motor 146, the drive sprocket 174, the driven sprocket 176 and the drive chain 178. Accordingly, the weights of the mixing drum 102, the hydraulic motor 146, the drive sprocket 174, the driven sprocket 176 and the drive chain 178 can be zeroed on the meter scale such that the operator of the mobile mixing apparatus 100 knows the weight of construction materials to load into the mixing drum 102 so the proper volume of binding composition (G5 adhesive binder) can be added to the construction materials.

Figure 17:
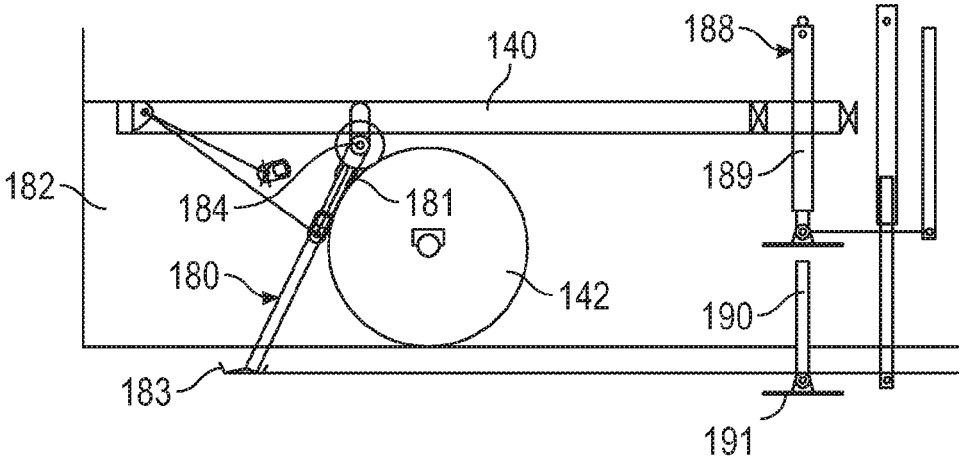
FIG. 17 is a side view of an exemplary front jack and rear jack on the support member of the mobile mixing apparatus.
Figure 18:
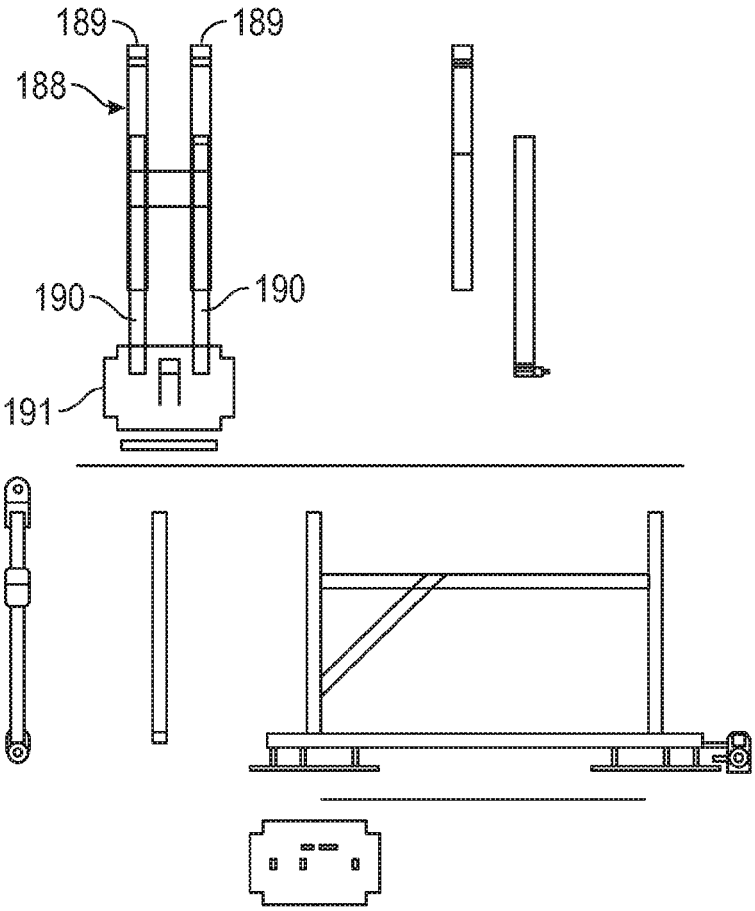
FIG. 18 is a front view of an exemplary rear jack.
Figure 19:
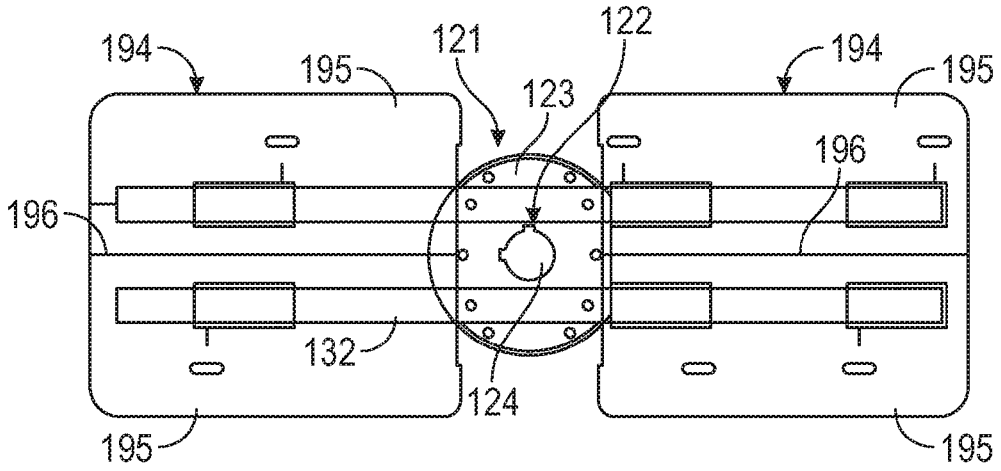
FIG. 19 is a top view of the paddle assembly with a pair of exemplary paddle covers on the paddle assembly.

As illustrated in FIGS. 17 and 18, in some embodiments, the at least one lifting device 120 (FIG. 9) may include at least one front jack 180 and at least one rear jack 188 that are positioned at the respective front and rear edges of the support member 140 to provide support thereto. The front jack 180 may include a front jack receptacle 181 which may be bolted, welded and/or otherwise attached to the support member 140 according to the knowledge of those skilled in the art. A front jack leg 182 may be selectively extendable from the front jack receptacle 181. A front jack foot 183 may terminate the lower end of the front jack leg 182 to support the front jack 180 on the ground or other support surface. In some embodiments, the front jack receptacle 181 may be pivotally attached to the support member 140 at a front jack pivot 184. The rear jack 188 may include at least one rear jack receptacle 189 which may be bolted, welded, pivotally attached and/or otherwise attached to the support member 140 according to the knowledge of those skilled in the art. A rear jack leg 190 may be selectively extendable from each rear jack receptacle 189. A rear jack foot 191 may terminate the lower end of each rear jack leg 190 to support the rear jack 188 on the ground or other support surface. Accordingly, in operation of the mobile mixing apparatus 100, the front jack or jacks 180 and the rear jack or jacks 188 may support the support member 140 in a stationary position at a selected height above the ground or other support surface.

In some embodiments, a pair of handles (not illustrated) may control the front jack 180 and the rear jack 188. The front jack 180 may be centered in the front of the mixing drum 102 and may not be capable of rotating because of the paddle adjustment bar 132, and the bottom front jack foot 183 of the front jack 180 may only swivel from front to back, as may the bottom rear jack foot 191 of the rear jack 188. As illustrated in FIG. 18, in some embodiments, the rear jack 188 may have two rear jack feet 191 and may be positioned sufficiently wide to provide stability when the support member 140 is lifted off of the ground or support surface. The rear jack 188 may then have a stable three-point footing which lifts sufficiently high that the main wheels 142 sufficiently clear the ground or support surface to allow positioning of a loader bucket or commercial wheel barrel (not illustrated) beneath the drum outlet 106 of the mixing drum 102.

Figure 20:
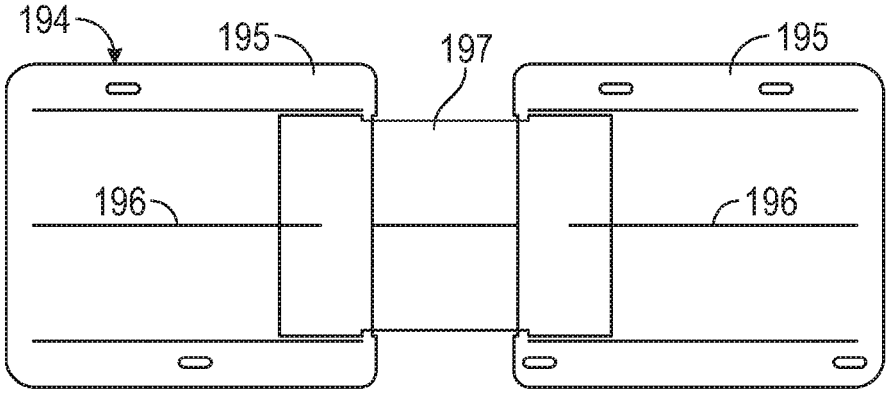
FIG. 20 is a bottom view of the exemplary paddle covers.
Figure 21:
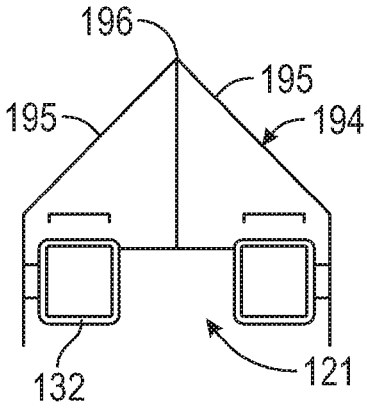
FIG. 21 is an end view of an exemplary paddle cover on the paddle assembly.
Figure 22:
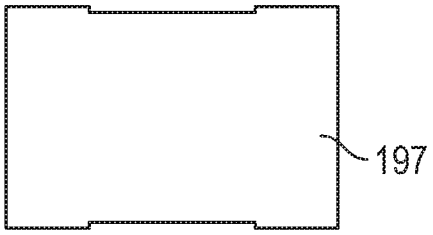
FIG. 22 is a top view of an exemplary paddle cover connector of the paddle covers.

Referring next to FIGS. 19-22 of the drawings, in some embodiments, a pair of paddle covers 194 may be provided on the paddle adjustment bar 132 of the paddle assembly 121. Each paddle cover 194 may be fabricated of a sheet or panel of polypropylene, such as ⅛" polypropylene, for example and without limitation. As illustrated in FIG. 21, in some embodiments, each paddle cover 194 may include a pair of sloped, adjacent paddle cover panels 195 which may be joined to each other along a central paddle cover apex 196. As illustrated in FIG. 20, in some embodiments, a paddle cover connector 197 may connect the adjacent paddle cover panels 195 to each other. Accordingly, the paddle covers 194 may keep the side paddle 126, the central paddle 138 and the base paddle 1365 clean and deflect contaminants from the side paddle 126, the base paddle 136 and the central paddle 138, as well as the adjustment bolts for the base paddle junction bracket 133 and the side paddle junction bracket 156, of the paddle assembly 121. Thus, the base paddle junction bracket 133 and the side paddle junction bracket 156 can be selectively adjusted quickly along the paddle adjustment bar 132 to facilitate selected positional adjustment of the side paddle 126, the base paddle 136 and the central paddle 138 in the drum interior 108 of the mixing drum 102 preparatory to mixing another type of construction material and facilitate maintenance and cleaning of the mobile mixing drum 102 and its contents. Consequently, the paddle covers 194 may facilitate job flow by enhancing the productivity and efficiency of the mobile mixing apparatus 100 due to the reduction of downtime for cleaning maintenance.

Referring next to FIG. 23 of the drawings, in some embodiments, the support member 140 may include at least one drive axle 200. The at least one drive axle 200 may drivingly engage a pair of main wheels 142. At least one drive axle motor 201, which may be hydraulic, may drivingly engage the drive axle 200 typically through an axle tube 202. The drive axle motor 201 may include a Warren hub that locks or unlocks to allow the drive axle motor 201 to operate the drive axle 200 in the clockwise direction or the counterclockwise direction. A pair of levers (not illustrated) may be provided in front of an operator's seat 158 (FIG. 1) to allow the support member 140 to be driven when uncoupled from a towing vehicle (not illustrated) and when the caster wheels 145 (FIG. 1) are locked in the down position. When the levers are positioned in opposite directions, the support member 140 may rotate in either direction clockwise or counterclockwise from the center of the drive axle 200. The ability to move either of the main wheels 142 separately or together in the same or opposite directions may enable placement of the mobile mixing apparatus 100 in hard-to-reach locations without damaging the area around it, as well as to be positioned for better access for the loading of construction materials into the mixing drum 102 as well as unloading of the finished product from the mixing drum 102.

Referring next to FIGS. 24-27 of the drawings, in some embodiments, at least one dump container assembly 210 may be provided on the guard assembly 144 on the mixing drum 102. A pair of the dump container assemblies 210 may be provided on each side of the guard assembly 144 in front of the chute hopper 154. Therefore, a dump container opening 218 may be provided in the arc 150 at each dump container assembly 210 to facilitate access of the dump container assembly 210 to the drum interior 108 of the mixing drum 102, for purposes which will be hereinafter described. Each dump container assembly 210 may include an assembly mount bracket 211 which may be bolted, welded and/or otherwise attached to the mixing drum 102. At least one assembly mount arm 212 may extend from the assembly mount bracket 211. A container platform 213 may be pivotally attached to the at least one assembly mount arm 212. In some embodiments, the container platform 213 may include a main platform panel 214 which is pivotally attached to the at least one assembly mount arm 212. A container support flange 215 may extend from the main platform panel 214. A container arm 216 may extend from the main platform panel 214 in spaced-apart relationship to the container support flange 215. In some embodiments, the container platform 213 may be fitted with a platform handle 217.

Figure 25:
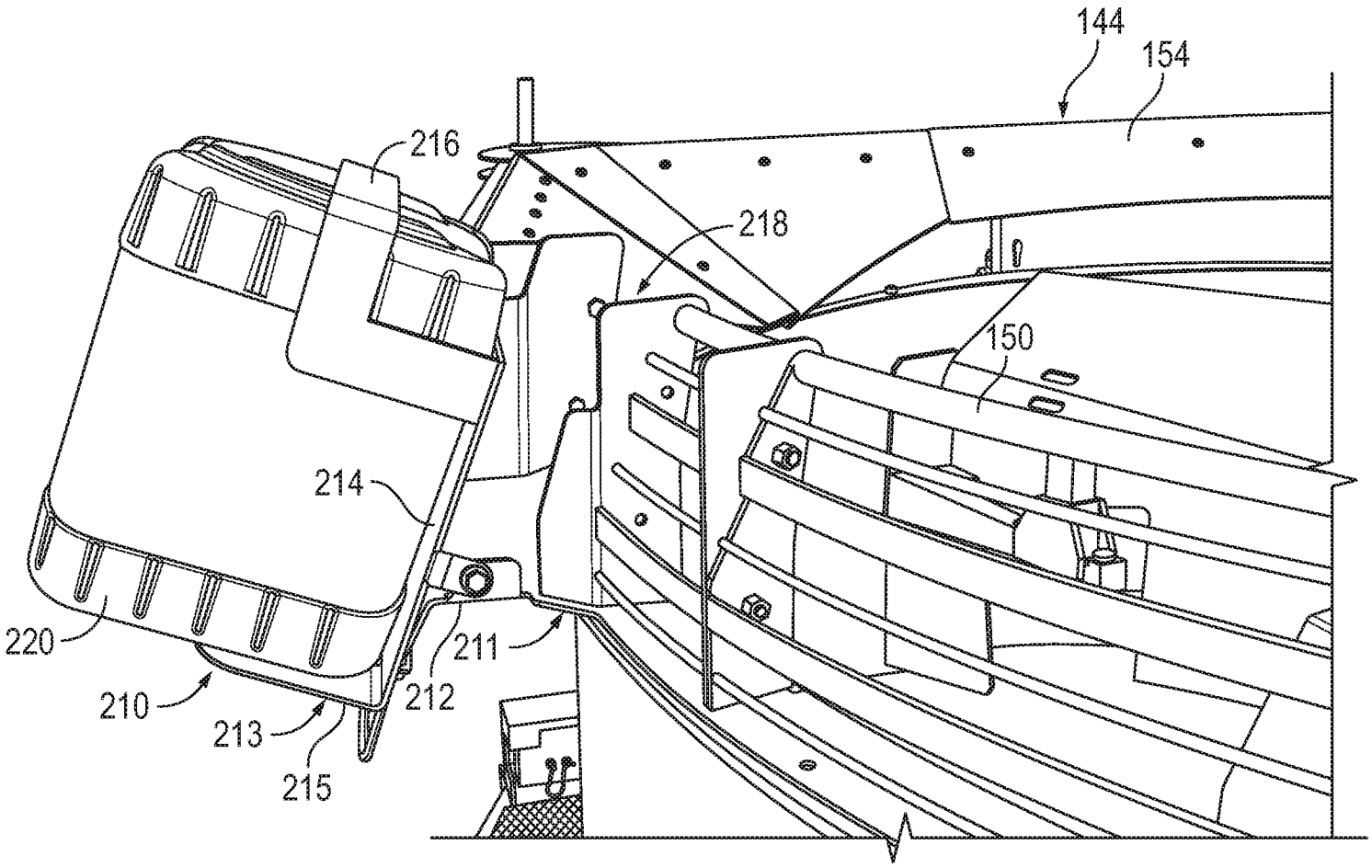
FIG. 25 is a perspective view of the exemplary dump container assembly, with a container supported by the container platform and the container platform deployed in the lowered position.
Figure 26:
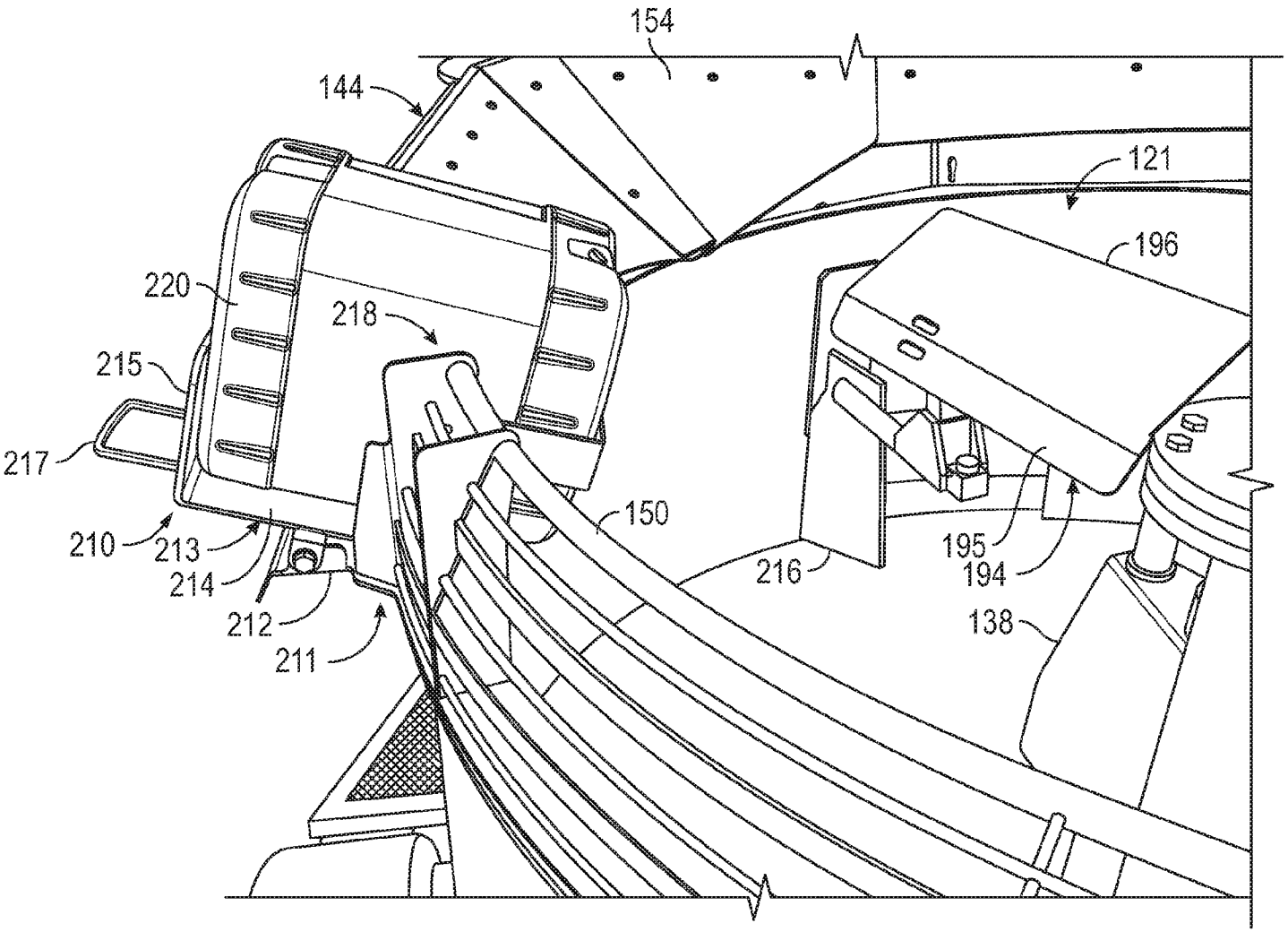
FIG. 26 is a perspective view of the container platform of the exemplary dump container assembly deployed in a raised position.
Figure 27:
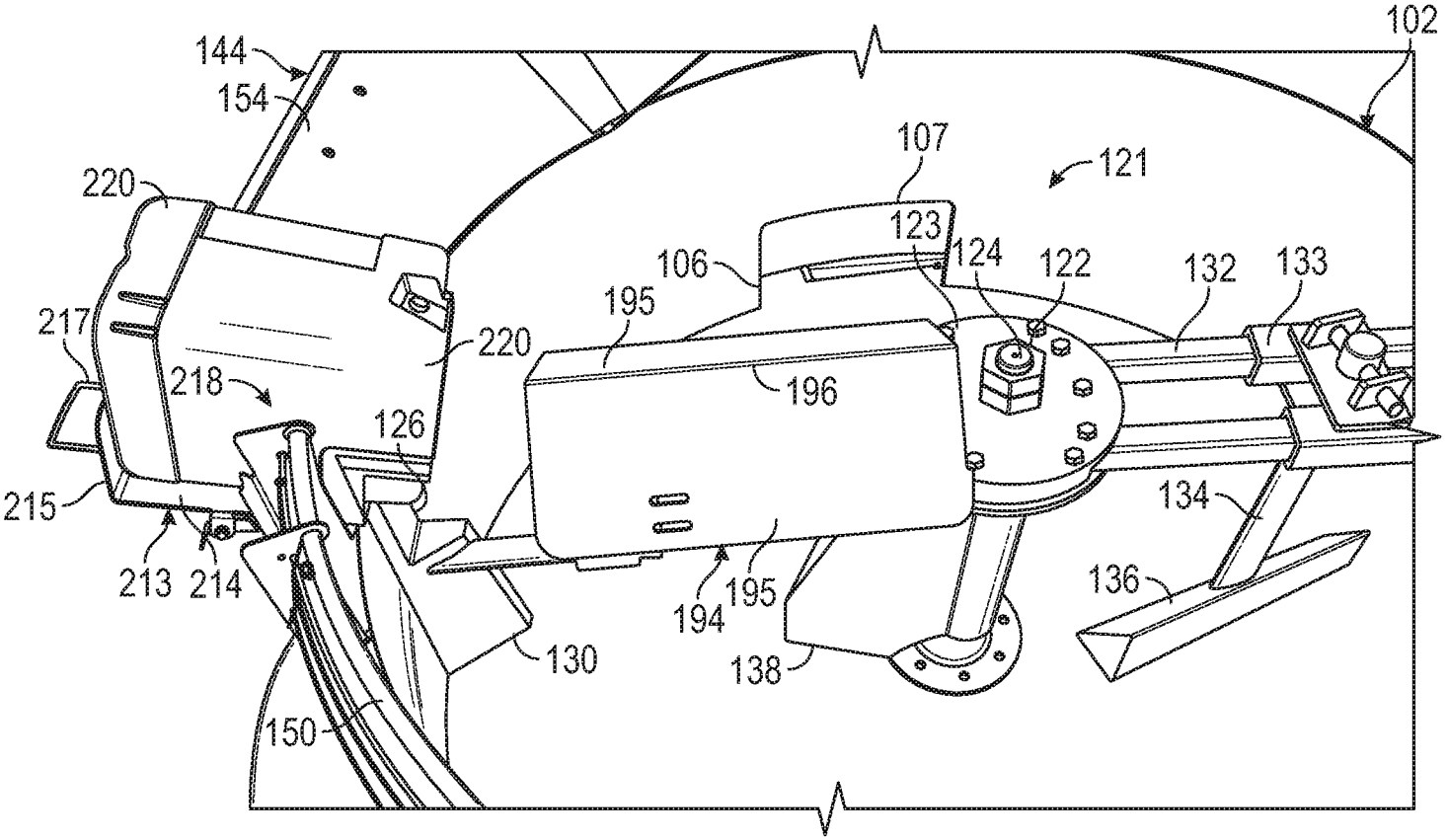
FIG. 27 is a perspective view of the exemplary dump container assembly with the container platform deployed in the raised position and additionally illustrating an exemplary paddle assembly in the drum interior of the mixing drum.

As illustrated in FIGS. 25-27, the container platform 213 may be configured to support a container 220 which rests on the container support flange 215 and is secured by the container arm 216. The container 220 may contain a supply of a construction material (not illustrated) which is to be placed in the drum interior 108 of the mixing drum 102 for mixing. In some embodiments, the container 220 may be a 5-gallon container. Accordingly, the container platform 213 may be positional between the lowered loading position illustrated in FIG. 25 for placement of the container 220 on the container platform 213 and the raised unloading position illustrated in FIGS. 26 and 27 to empty the construction material from the container 220 by gravity into the drum interior 108. After the construction material has been emptied from the container 220, the container platform 213 can be selectively returned to the lowered position illustrated in FIG. 25.

In some embodiments, the main wheels 142 may be mounted on an axle (not illustrated) which is split such that the split axle can be bolted together on a middle support (not illustrated) on the support member 140, and may also be supported on tubes (not illustrated) on each side of an outer frame (not illustrated) of the support member 140. The split axle may not move unless rotated up for storage. A castor may be welded to each end of the outer portion of the split axle. A lever (not illustrated) on the caster wheels 145 may bottom out on the under part of the support member 140, and may remain pinned in that position when in use. When the pins are pulled and the support member 140 is lifted by the hydraulic front jack or the side trailer jack, the split axle may then rotate such that the main wheels 142 will then tilt and fall into place in their saddles on each side for towing of the mobile mixing apparatus 100.

In some embodiments, an axle which is bolted on the springs (not illustrated) of the support member 140 may have two flanges (not illustrated) welded on each side to accept a hydraulic wheel motor with Warren hubs placed just behind the spring axle, allowing the height of the support member 140 to be close to original without the drive motors. These motors may have electric solenoid valves operated by a foot pedal which opens the hydraulic circuit for operation.

Figure 8:
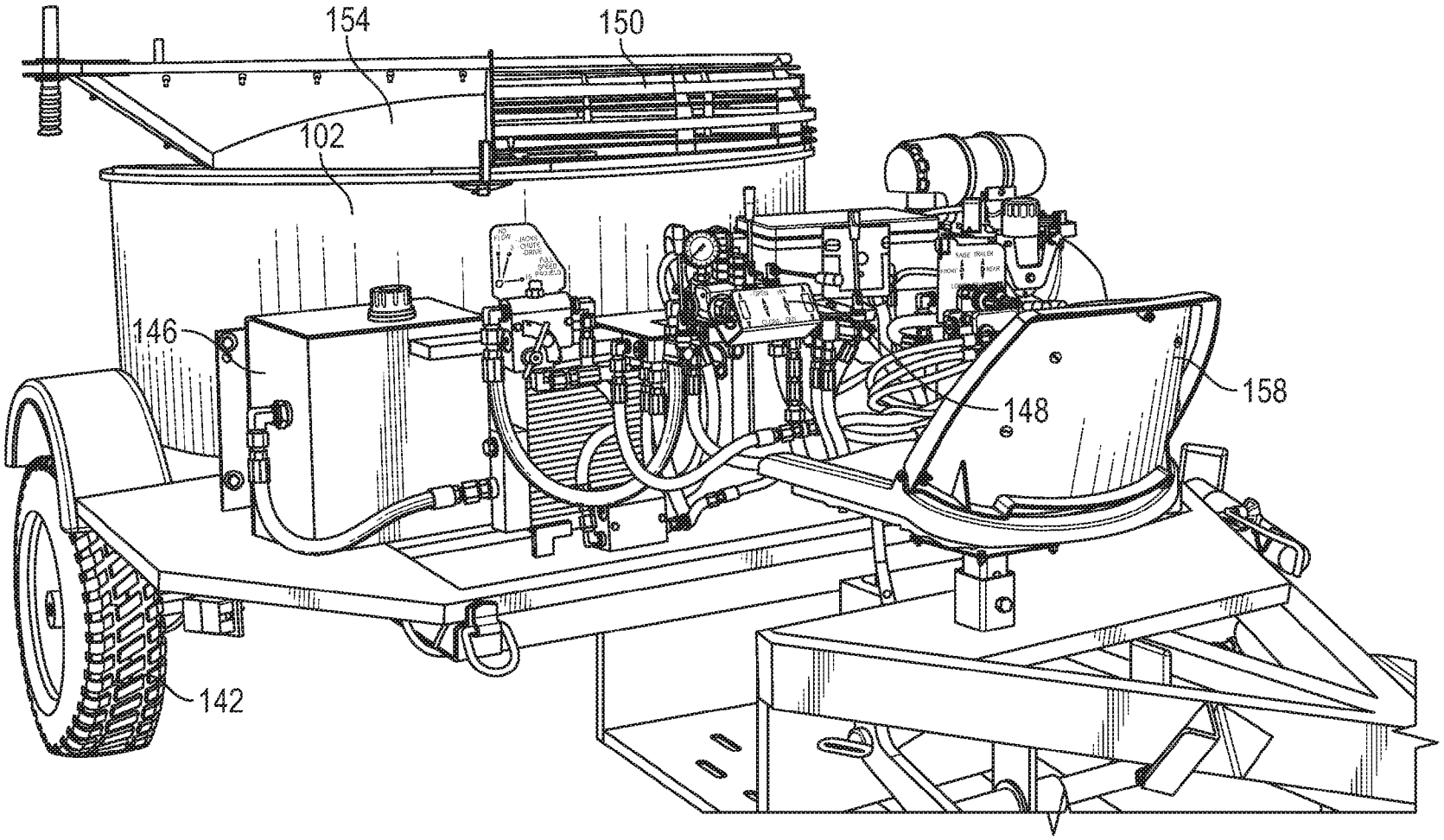
FIG. 8 illustrates a perspective view of an exemplary support member of the mobile mixing apparatus, in accordance with an illustrative embodiment of the present invention.

As illustrated in FIG. 8, in some embodiments, a control portion 148 may be provided on the support member 140. An operator seat 158 may be provided on the support member 140 to provide access for an operator (not illustrated) seated in the operator seat 158 to the control portion 148. In some embodiments, the operator seat 158 may swivel with respect to the support member 140, and may include a seat belt (not illustrated). The control portion 148 may include levers and switches (not illustrated) which enable control of the paddle assembly 121 in the mixing drum 102, the at least one motor 146, the at least one lifting device 120, for retracting the main wheels 142 while operating the mixing drum 102, the drum outlet door 107 (FIG. 7) on the mixing drum 102 and general functions for loading and unloading construction materials in the mixing drum 102. The control portion 148 may include a hydraulic drive assembly (not illustrated) that is speed-controlled and has an electric pressure control valve that lock the main wheels 142 when no pressure is in the line. In some embodiments, the hydraulic drive assembly may include an electric valve (not illustrated) which operates to allow oil to the drive motors when a foot switch is energized, wherein an operator must be seated in the operator seat 158 to activate the foot switch. The control portion 148, including the throttle and the kill switches, may be positioned in such a manner as to enable an operator of the mobile mixing apparatus 100 to view the mixing drum 102, and may be at the front of the support member 140 within comfortable reach of the operator.

In some embodiments, the control portion 148 may include a pair of lever-actuated hydraulic valves (not illustrated) spaced-apart at shoulder width. The hydraulic valves may be operably connected to the drive motor or motors which drivingly engage the main wheel or wheels 142. When an operator at the control portion 148 pushes the levers of the hydraulic valves forward, the support member 140 may move in reverse; when the levers of the hydraulic valves are pulled back, the support member 140 may move forward. Accordingly, the hydraulic valves and drive motors may allow positioning of the apparatus 100 very quickly with ease.

Figure 10A:
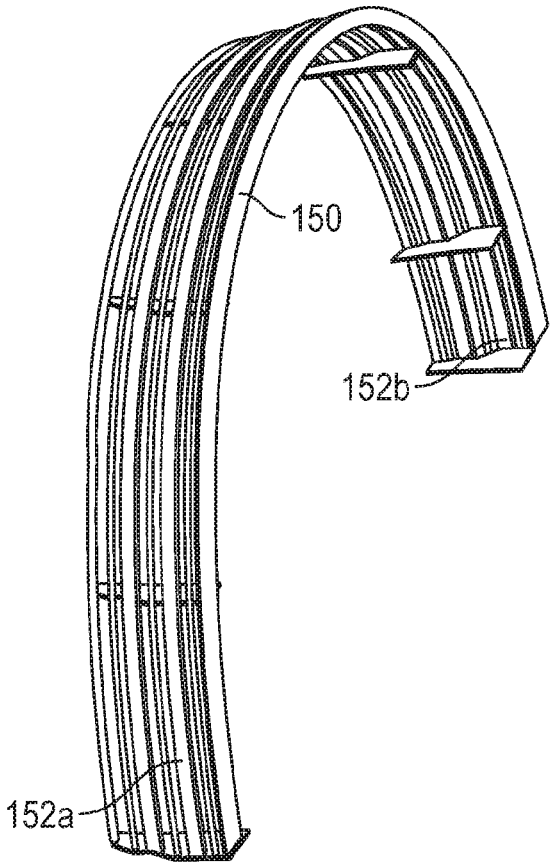
FIG. 10A illustrates a perspective view of a typical arc on an exemplary guard assembly of the mobile mixing apparatus, in accordance with an illustrative embodiment of the present invention.
Figure 10B:
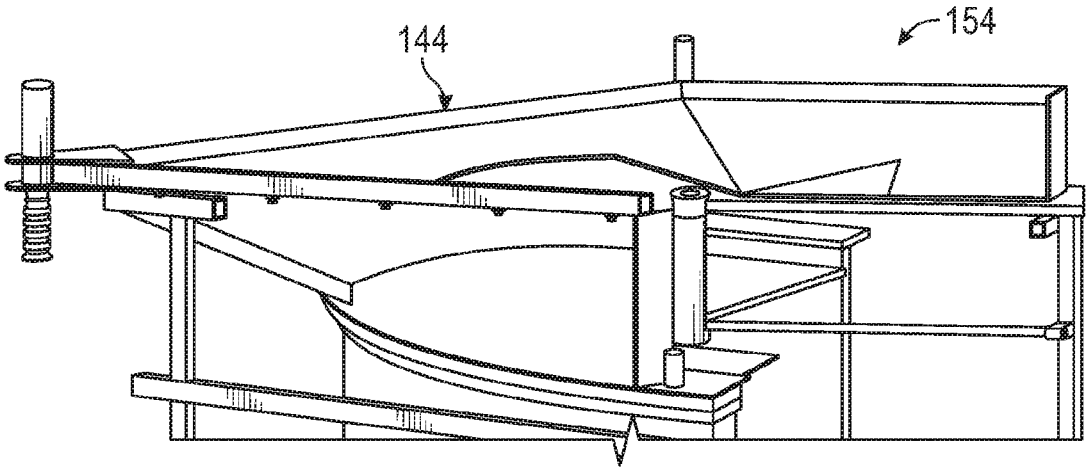
FIG. 10B illustrates a perspective view of a typical chute hopper on an exemplary guard assembly of the mobile mixing apparatus, in accordance with an illustrative embodiment of the present invention.
Figure 11:
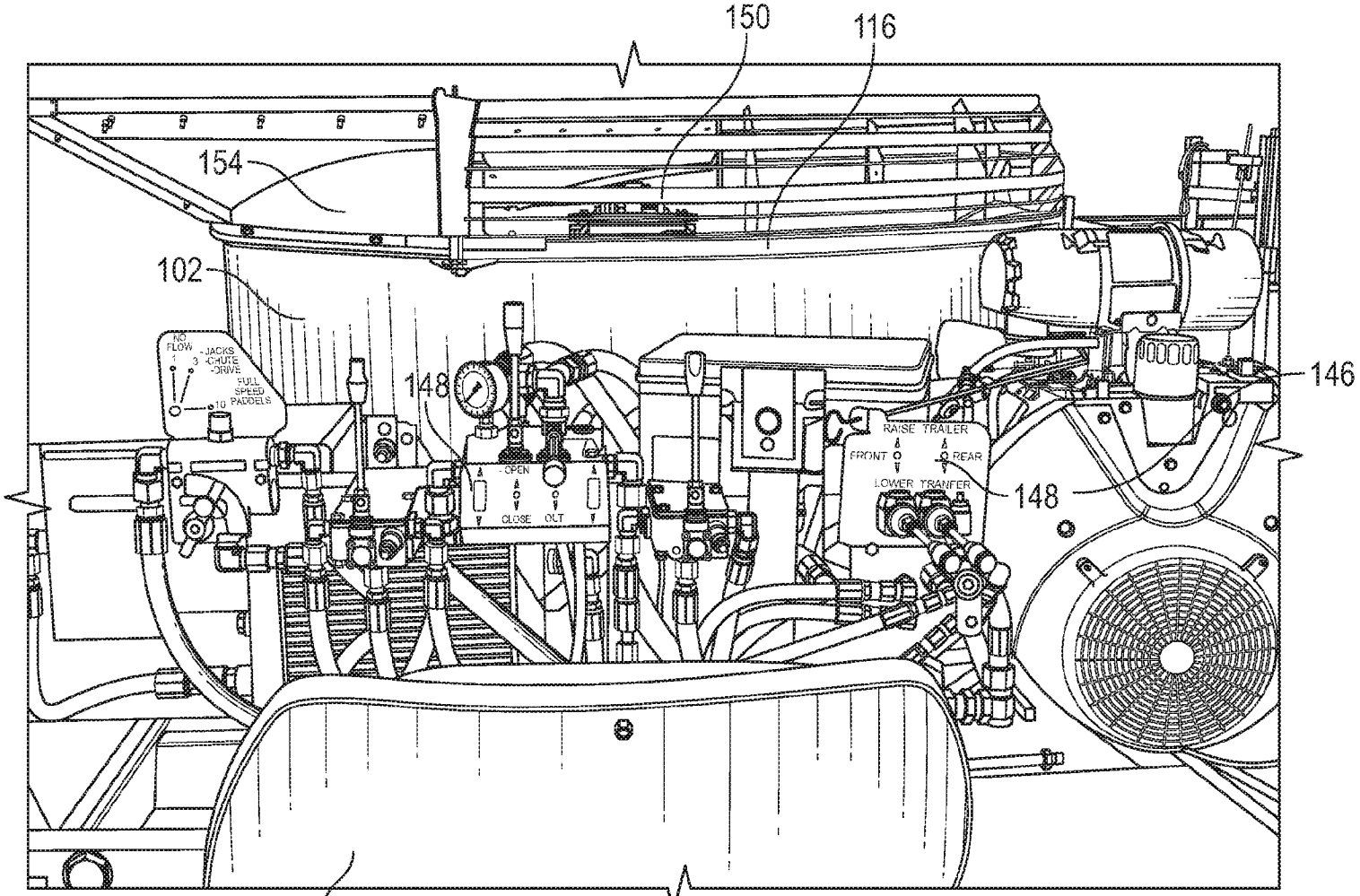
FIG. 11 illustrates a front view of an exemplary control portion of the mobile mixing apparatus with an adjacently positioned seat, in accordance with an illustrative embodiment of the present invention.

A guard assembly 144 may be provided on the mixing drum 102 for restricting access of the hands of an operator or other person to the open drum end 116 of the mixing drum 102. As illustrated in FIGS. 1, 8, 15 and 16, in some embodiments, the guard assembly 144 may include at least one arc 150 and a chute hopper 154 which provide a protective semi-circular guard over the open drum end 116 of the mixing drum 102. As shown in FIGS. 10A and 10B, the at least one arc 150 and the chute hopper 154 of the guard assembly 144 may at least partially restrict entry of a person's hands (not illustrated) through the open drum end 116 of the mixing drum 102 for protective purposes during operation of the mobile mixing apparatus 100. As illustrated in FIG. 10A, the at least one arc 150 may include a pair of free arc ends 152*a*, 152*b*. Each free arc end 152*a*, 152*b* may be attached to a periphery on the open drum end 116 of the mixing drum 102. In this manner, the at least one arc 150 may at least partially restrict access of the person's hands through the open drum end 116 of the mixing drum 102. The arc 150 is unique in that it rotates around the mixing drum 102 on the support member 140 and acts as a shielded guard to keep hands out of the mixing drum 102 through the rotating arc 150.

In some embodiments, the arc 150 may fit on top of the mixing drum 102 with a clearance between the mixing drum 102 and the arc 150. The arc 150 may be supported by an ultra-high-molecular-weight polyethylene (not illustrated) which may be welded just below the top of the mixing drum 102. Those skilled in the art will recognize that the ultra-high-molecular-weight polyethylene is very slick and non-adhesive, and is attached to the arc 150 so that it can easily be rotated around the mixing drum 102. The ultra-high-molecular-weight polyethylene may be positioned to balance the weight and tapered on the edges to clean debris on the arc 150 when it is rotated. In some embodiments, two handles (not illustrated) may be attached to the arc 150 to facilitate desired positioning of the arc 150 on the mixing drum 102.

The chute hopper 154 of the guard assembly 144 may help support the arc 150 during rotation, and may also restrict access to the open drum end 116. The chute hopper 154 and the arc 150 may rotate to allow the chute hopper 154 to be positioned on either side or rear of the support member 140. The chute hopper 154 and the arc 150 may each form a corresponding half of a ring which rotates with respect to the mixing drum 102. The guard assembly 144 may be restricted from inadvertently bouncing off the mixing drum 102 in transit by locking pins (not illustrated) which are loose enough for the arc 150 and hopper 154 to rotate, and may be removed when needed. The arc 150 may be sufficiently open to enable an operator to easily view the mixture in the mixing drum 102 without enabling a person to extend a hand into the drum interior 108. The chute hopper 154 may be sufficiently wide to accommodate a large loader bucket (not illustrated) which may dump the construction materials into the drum interior 108 without spilling the mixture outside the mixing drum 102. The arc 150 and the chute hopper 154 may be removed easily for repair or cleaning of the mixing drum 102 or as adjustments are made to the paddle assembly 121.

As illustrated in FIG. 12, in some embodiments, at least one interior load cell 172 may be provided in the drum interior 108 of the mixing drum 102 for weighing granules and binding components. In some embodiments, various motors, axles, adjustable bars, and jacks (not illustrated) may provide additional mobility and adjustability to the aforementioned components of the mobile mixing apparatus 100 according to the knowledge of those skilled in the art.

The mixing drum 102 may include a generally concave container configured to contain the construction materials which are mixed in the drum interior 108. Those skilled in the art will recognize that the construction materials may have a proclivity to stick to the side inner surface 110, the base inner surface 112 and the central inner surface 114 of the mixing drum 102, and thus, may not mix uniformly if these surfaces are not fully engaged during the mixing process. Accordingly, the apparatus 100 may utilize a plurality of adjustable paddles 126, 136, 138 of the paddle assembly 121 to uniformly engage these respective inner surfaces in the drum interior 108 of the mixing drum 102 to optimize removal of the construction materials which adhere to these surfaces and mixing of the materials. In some embodiments, the plurality of adjustable paddles 126, 136, 138 may include the side paddle 126 which engages the side inner surface 110 of the side drum wall 104, the base paddle 136 which engages the base inner surface 112 and the central paddle 138 which engages the central inner surface 114 of the base drum end 118, as was heretofore described. The side paddle 126, the base paddle 136 and the central paddle 138 may each include generally planar members or blocks that are oriented to manipulate the construction materials inside the mixing drum 102, as well as shear the residue of construction materials that remains on the side inner surface 110, the base inner surface 112, and the central inner surface 114, respectively, of the mixing drum 102. The side paddle 126, the base paddle 136 and the central paddle 138 may also be effective for urging the construction materials towards the drum outlet 106 (FIG. 2) in the mixing drum 102.

In some embodiments, the side paddle 126, the base paddle 136 and the central paddle 138 can be adjustably traversed to fully engage the side inner surface 110, the base inner surface 112, and the central inner surface 114, respectively, of the mixing drum 102. The side paddle 126, the base paddle 136 and the central paddle 138 may be adjustably disposed to extend and retract radially, adjust in position vertically, and pivot at various angles against the side inner surface 110, the base inner surface 112, and the central inner surface 114 of the mixing drum 102, using suitable mounting brackets and/or other mechanisms or structures according to the knowledge of those skilled in the art. In this manner, the side paddle 126, the base paddle 136 and the central paddle 138 may selectively maximize engagement with the side inner surface 110, the base inner surface 112, and the central inner surface 114, respectively, of the mixing drum 102 and most efficiently extrude the construction materials from the drum outlet 106.

In some embodiments, the mixing apparatus 100 may comprise:

a mixing drum 102, the mixing drum 102 including a base end 118, a generally cylindrical side drum wall 104 extending from the base end 118 and an open drum end 116 opposite the base end 118, the side drum wall 104 surrounding a hollow drum interior 108 extending in a longitudinal direction between the open drum end 116 and the base drum end 118, the side drum wall 104 having a drum outlet 106, the drum outlet 106 configured to be selectively opened and closed, the hollow drum interior 108 having a side inner surface 110, a base inner surface 112, and a central inner surface 114, the base drum end 118 having a drive axle opening 168;

a drive axle 122, the drive axle 122 defined by a first axle end 124 end and a second axle end 125, the drive axle 122 disposed to pass through the drive axle opening 168 and position generally concentric to the base drum end 118 of the mixing drum 102, the drive axle 122 configured to rotate about a longitudinal axis of the mixing drum 102 in either a first direction or a second direction opposite to the first direction;

a paddle adjustment bar 132, the paddle adjustment bar 132 disposed to attach to the first axle end 124 of the drive axle 122 in a generally perpendicular orientation, the paddle adjustment bar 132 further disposed to extend across the open drum end 116 of the mixing drum 102;

a side paddle 126, the side paddle 126 defined by a parallel paddle portion 128 oriented generally coplanar with the side inner surface 110, and a perpendicular paddle portion 130 oriented generally perpendicular to the side inner surface 110, the side paddle 126 supported in an adjustable relation to the paddle adjustment bar 132, wherein the side paddle 126 is configured to radially traverse the length of the paddle adjustment bar 132, the side paddle 126 further configured to pivot laterally and vertically in relation to the paddle adjustment bar 132;

a base paddle 136, the base paddle 136 defined by a generally planar shape, the base paddle 136 oriented coplanar to the base inner surface 112, the base paddle 136 supported in an adjustable relation to the paddle adjustment bar 132 with a base bar 134 that extends there between, wherein the base paddle 136 is configured to radially traverse the length of the paddle adjustment bar 132, the base paddle 136 further configured to rotate in relation to the paddle adjustment bar 132;

a central paddle 138, the central paddle 138 defined by a generally planar shape, the central paddle 138 oriented perpendicular to the central inner surface 114, the central paddle 138 supported in a fixed relation to the drive axle 122 to extend generally radially from the drive axle 122, wherein the side paddle 126, the base paddle 136 and the central paddle 138 are arranged for rotation against the side inner surface 110, the base inner surface 112, and the central inner surface 114 of the mixing drum 102 and about the longitudinal axis of the mixing drum 102, wherein the paddles are oriented to urge construction materials towards the drum outlet 106 of the mixing drum 102 during rotation;

a support member 140, the support member 140 configured to at least partially support the mixing drum 102, the support member 140 comprising a plurality of main wheels 142, at least one lifting device 120, and at least one motor 146;

a guard assembly 144, the guard assembly 144 comprising at least one arc 150 and a chute hopper 154, the at least one arc 150 defined by a pair of free ends, each free end disposed to attach to a periphery on the open drum end 116 of the mixing drum 102, wherein the at least one arc 150 at least partially restricts access to the open drum end 116 of the mixing drum 102; and at least one exterior load cell 170, the at least one exterior load cell 170 disposed to operatively connect to the mixing drum 102, wherein the at least one exterior load cell 170 weighs the contents of the mixing drum 102.

In another aspect, the mixing drum 102 may be arranged to receive and mix construction materials such as a granule and a binding composition.

In another aspect, the binding composition may include decomposed granite 35 and the binding composition may include G5 binder.

In another aspect, the drive axle 122 may be at least partially controlled by a detente mixer valve (not illustrated) which facilitates rotation of the drive axle 122 in a first direction (clockwise) or a second direction (counter clockwise).

In another aspect, the side paddle 126 may be arranged for rotation along and against the side inner surface 110 of the mixing drum 102.

In another aspect, the paddles 126, 136, 138 may work together to urge the construction materials through the drum outlet 106 of the mixing drum 102.

In another aspect, the drum outlet 106 may include a guillotine-type drum outlet door 107.

In another aspect, the at least one paddle adjustment bar 132 of the paddle assembly 121 may include a pair of parallel bars and a base paddle junction bracket 133 and a side paddle junction bracket 156 that adjustably traverse the length of the parallel bars.

In another aspect, the base paddle junction bracket 133 and a side paddle junction bracket 156 may each be fastened into place on the paddle adjustment bar 132 with a threaded bolt.

In another aspect, the support member 140 may include a trailer.

In another aspect, the trailer may include an operator seat 158 attached on one end.

In yet another aspect, the operator seat 158 may provide accessibility to a control portion 148.

In yet another aspect, the control portion 148 may enable control of the at least one motor 146, the at least one lifting device 120, the drum outlet door 107 for the drum outlet 106 on the mixing drum 102, and general functions for loading and unloading the construction materials in the mixing drum 102.

In yet another aspect, the plurality of main wheels 142 may have a pair of caster wheels 145 that adjustably lock when the support member 140 is lifted during mixing operations.

In yet another aspect, the at least one lifting device 120 may include a front jack and a rear jack.

In yet another aspect, the at least one motor 146 may include at least one hydraulic wheel motor.

In yet another aspect, the at least one motor 146 may operatively connect to the drive axle 122, the at least one lifting device 120, and the at least one exterior load cell 170.

In yet another aspect, the at least one exterior load cell 170 may include a front exterior load cell 170 and a rear exterior load cell 170 mounted to the support member 140.

In yet another aspect, the at least one arc 150 of the guard assembly 144 may be coated with ultra-high-molecular-weight polyethylene.

In yet another aspect, the at least one arc 150 of the guard assembly 144 may include a pair of handles for adjustable positioning over the open drum end 116 of the mixing drum 102.

In yet another aspect, the control portion 148 may include a hydraulic drive assembly that is speed controlled and an electric pressure control valve that lock the main wheels 142 when no pressure is in the line.

In yet another aspect, the hydraulic drive assembly may also include an electric valve which operates to allow oil to the drive motors when a foot switch is energized, wherein an operator must be seated in the operator seat 158 to activate the foot switch.

One objective of the present invention is to optimize engagement with the construction materials being mixed in the mixing drum 102.

Another objective is to shear a substantial amount of the construction materials from the inner surfaces of the mixing drum 102.

Yet another objective is to regulate discharge of the mixed construction materials through a drum outlet 106 having a drum outlet door 107 that moves between an open position and a closed position.

Yet another objective is to provide a mixing apparatus 100 that can be used to efficiently mix decomposed granite 35 G5 binder.

Yet another objective is to allow the trailer or other support member 140 to be driven on golf courses and paths without the need to be towed, eliminating or minimizing damage to the grounds and also be stored at night without the need of a truck or other towing vehicle to move the support member 140.

Yet another objective is provide a mobile mixing apparatus 100 having a mixing drum 102 with sufficient capacity to carry a load of up to 1500 pounds.

Yet another objective is to provide a mobile mixing apparatus 100 that is inexpensive to construct and easy to use.

In typical application, the mobile mixing apparatus 100 may be used for mixing construction materials such as granules and binding compositions that have a proclivity to stick to the side inner surface 110, the base inner surface 112 and/or the central inner surface 114 of the mixing drum 102. The granules may include, without limitation, decomposed granite, sand, cement, concrete, and fill dirt. The binding compositions may include, without limitation, G5 binder, tar, oil, and water. In some embodiments, the mobile mixing apparatus 100 can mix most any cement product. Some embodiments, however, may enable the mixing of decomposed granite or sand with G5 binder and with or without road base. Those skilled in the art will recognize that reground asphalt with only the binder may be at least 4-6 times stronger than regular asphalt. Additionally, adding water to all of the cement products is optimal, but the granite or sand may use Technisoil™ binder which may improve the strength and provide greater longevity for the mixed composition. Furthermore, the Technisoil™ binder is impervious to diesel, gas, and oil.

The open drum end 116 of the mixing drum 102 may initially receive the construction materials into the drum interior 108 preparatory to mixing of the construction materials in the mixing drum 102. For example and without limitation, in some applications, the construction materials may be dropped from a loader bucket (not illustrated) through the open drum end 116 into the drum interior 108. The exterior load cell or cells 170 may weigh the mixing drum 102 with the construction materials in the drum interior 108. Additionally or alternatively, the interior load cell 172 may weigh the construction materials in the drum interior 108.

Operation of the motor 146 (FIG. 1) rotates the paddle assembly 121 in the drum interior 108. Accordingly, the drive axle 122 rotates the central paddle 138 such that the central paddle lower edge 139 scrapes the construction materials from the central inner surface 114. The drive axle 122 additionally rotates the drive hub 123, which rotates the at least one paddle adjustment bar 132 in the drum interior 108. Thus, the at least one paddle adjustment bar 132 rotates the side paddle 126 and the base paddle 136 against the side inner surface 110 and the base inner surface 112, respectively. The side paddle 126 scrapes the construction materials from the side inner surface 110, and the base paddle 136 scrapes the construction materials from the base inner surface 112. After mixing is completed, the drum outlet door 107 (FIG. 7) may be opened. Continued rotation of the paddle assembly 121 may cause the side paddle 126 to force the construction materials from the drum interior 108 through the open drum outlet 106 and into a suitable collection vessel (not illustrated).

In some embodiments, the perpendicular paddle portion 130 may form a right triangle shape with respect to the parallel paddle portion 128 of the side paddle 126 such that the 90° perpendicular paddle portion 130 of the side paddle 126 helps the construction material mixture to discharge through the drum outlet 106 when the paddle assembly 121 is rotated clockwise in the drum interior 108. The side paddle 126 may mix more efficiently when rotating counter clockwise, but the mixture may still be urged from the drum outlet 106 faster in the clockwise direction. The unique double shape of the side paddle 126 is effective because the construction material mixture may stick to the side inner surface 110 of the mixing drum 102 if not scraped off, but in the event that the side paddle 126 is tapered too high, the construction material mixture may tend to build up and over flow the mixing drum 102. In some applications, the side paddle 126 may function better when adjusted away from the side inner surface 110 of the mixing drum 102 during mixing operations. This may be accomplished by sliding adjustment of the transverse paddle arm 166 relative to the paddle arm bracket 164.

The base paddle 136 mixes the construction materials along the base inner surface 112 of the mixing drum 102. In some embodiments, the base paddle 136 may take the shape of a right triangle and may be tapered to the outside so that it directs the construction material mixture in the direction of the taper. The base paddle 136 may have a flat side that is angled to urge the mixture to an angled side and flip the mixture upwardly into the drum interior 108. When rotating clockwise, the base paddle 136 may be rotated counterclockwise from center such that the mixture is urged towards the flat side of the base paddle 136 and towards the drum outlet 106 for discharge.

The central paddle 138 mixes the construction materials along the central inner surface 114 of the mixing drum 102. In some embodiments, the central paddle 138 may have a generally planar and tapered V-shape. The central paddle 138 may be oriented perpendicular to the central inner surface 114 such that the central paddle lower edge 139 of the central paddle 138 shears an area proximal to the central inner surface 114 and the drive axle 122. In operation, the central paddle 138 may divert the mixture away from the drive axle 122 and shear the mixture off the surface of the drive axle 122. The central paddle 138 may also push the mixture in either a clockwise or a counterclockwise direction to clean the central inner surface 114 of the mixing drum 102 better in each direction.

In some applications, the lifting device 120 (FIG. 9) may be operated to selectively raise or lower the mixing drum 102 on the support member 140.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A mobile mixing apparatus for ensuring optimal mixing of a material, the mobile mixing apparatus comprising:

a support member, the support member mobile on a support surface;

a mixing drum carried by the support member, the mixing drum having a base drum end, a side drum wall extending from the base drum end, an open drum end opposite the base drum end, a drum interior extending between the base drum end and the open drum end, a central inner surface and a base inner surface on the base drum end and a side inner surface on the side drum wall and facing the drum interior;

a paddle assembly disposed for rotation in the drum interior of the mixing drum, the paddle assembly including a plurality of paddles engaging the central inner surface, the base inner surface and the side inner surface, respectively, of the mixing drum, wherein the plurality of paddles of the paddle assembly comprises a central paddle engaging the central inner surface, a base paddle engaging the base inner surface and a side paddle engaging the side inner surface and wherein the paddle assembly comprises a drive axle drivingly engaged for rotation by the at least one motor and at least one elongated paddle adjustment bar drivingly engaged for rotation by the drive axle, and wherein the central paddle is carried by the drive axle and the base paddle and the side paddle are carried by the at least one paddle adjustment bar; and at least one motor drivingly engaging the paddle assembly for rotation in the drum interior of the mixing drum.

2. The apparatus of claim 1 further comprising at least one paddle cover carried by the paddle assembly.

3. The apparatus of claim 1 further comprising a drum outlet in the side drum wall of the mixing drum and a drum outlet door disposed between open and closed positions at the drum outlet.

4. The apparatus of claim 1 further comprising a base bar carried by the at least one paddle adjustment bar, and wherein the base paddle is carried by the base bar.

5. The apparatus of claim 1 further comprising a descending paddle arm carried by the at least one paddle adjustment bar and a transverse paddle arm carried by the descending paddle arm, and wherein the side paddle is carried by the transverse paddle arm.

6. The apparatus of claim 1 wherein the side paddle comprises a parallel paddle portion carried by the at least one paddle adjustment bar and a perpendicular paddle portion carried by the parallel paddle portion, the parallel paddle portion generally parallel to the side inner surface and the perpendicular paddle portion generally perpendicular to the side inner surface.

7. The apparatus of claim 1 further comprising a guard assembly including an arc and a chute hopper carried by open drum end of the mixing drum, the chute hopper and the arc each forming a corresponding half of a ring rotatable with respect to the mixing drum.

8. The apparatus of claim 7 wherein the at least one arc comprises a pair of free arc ends carried by the open drum end of the mixing drum.

9. The apparatus of claim 1 further comprising at least one dump container assembly including an assembly mount bracket carried by the mixing drum, a container platform pivotally carried by the assembly mount bracket and a container carried by the container platform, the container platform selectively positional in a loading position and an unloading position.

10. The apparatus of claim 1 further comprising at least one load cell carried by the support member, and wherein the mixing drum is carried by the at least one load cell.

11. The apparatus of claim 1 further comprising a drive axle carried by the support member, at least one castor wheel carried by the support member, a pair of main wheels carried by the drive axle and a drive axle motor drivingly engaging the drive axle.

12. A mobile mixing apparatus for ensuring optimal mixing of a material, the mobile mixing apparatus comprising:

a support member, the support member mobile on a support surface;

at least one load cell carried by the support member;

a mixing drum carried by the at least one load cell, the mixing drum having a base drum end, a side drum wall extending from the base drum end, an open drum end opposite the base drum end, a drum interior extending between the base drum end and the open drum end, a central inner surface and a base inner surface on the base drum end and a side inner surface on the side drum wall and facing the drum interior;

a drum outlet in the side drum wall of the mixing drum;

a drum outlet door disposed between open and closed positions at the drum outlet;

a paddle assembly disposed for rotation in the drum interior of the mixing drum, the paddle assembly including a drive axle disposed in the drum interior, a central paddle carried by the drive axle, a drive hub carried by the drive axle, at least one paddle adjustment bar carried by the drive hub, a base paddle junction bracket carried by and adjustable along the length of the at least one paddle adjustment bar, a base paddle carried by the base bar, a side paddle junction bracket carried by and adjustable along the length of the at least one paddle adjustment bar, a descending paddle arm carried by the side paddle junction bracket, a paddle arm bracket carried by the descending paddle arm, a transverse paddle arm carried by the paddle arm bracket and a side paddle carried by the transverse paddle arm, the central paddle, the base paddle and the side paddle engaging the central inner surface, the base inner surface and the side inner surface, respectively, of the mixing drum; and at least one motor drivingly engaging the drive axle of the paddle assembly for rotation in the drum interior of the mixing drum.

13. The apparatus of claim 12 further comprising at least one paddle cover carried by the paddle assembly.

14. The apparatus of claim 12 wherein the side paddle comprises a parallel paddle portion carried by the transverse paddle arm and a perpendicular paddle portion carried by the parallel paddle portion, the parallel paddle portion generally parallel to the side inner surface and the perpendicular paddle portion generally perpendicular to the side inner surface.

15. The apparatus of claim 12 further comprising a guard assembly including an arc and a chute hopper carried by open drum end of the mixing drum, the chute hopper and the arc each forming a corresponding half of a ring rotatable with respect to the mixing drum.

16. The apparatus of claim 15 wherein the at least one arc comprises a pair of free arc ends carried by the open drum end of the mixing drum.

17. A mobile mixing apparatus for ensuring optimal mixing of a material, the mobile mixing apparatus comprising:

a support member, the support member mobile on a support surface;

at least one exterior load cell carried by the support member;

a mixing drum carried by the at least one load cell, the mixing drum having a base drum end, a side drum wall extending from the base drum end, an open drum end opposite the base drum end, a drum interior extending between the base drum end and the open drum end, a central inner surface and a base inner surface on the base drum end and a side inner surface on the side drum wall and facing the drum interior;

at least one interior load cell in the drum interior;

a drum outlet in the side drum wall of the mixing drum;

a drum outlet door disposed between open and closed positions at the drum outlet;

a paddle assembly disposed for rotation in the drum interior of the mixing drum, the paddle assembly including a drive axle disposed in the drum interior, a central paddle carried by the drive axle, a drive hub carried by the drive axle, at least one paddle adjustment bar carried by the drive hub, a base paddle junction bracket carried by and adjustable along the length of the at least one paddle adjustment bar, a base paddle carried by the base bar, a side paddle junction bracket carried by and adjustable along the length of the at least one paddle adjustment bar, a descending paddle arm carried by the side paddle junction bracket, a paddle arm bracket carried by the descending paddle arm, a transverse paddle arm carried by the paddle arm bracket and a side paddle carried by the transverse paddle arm, the central paddle, the base paddle and the side paddle engaging the central inner surface, the base inner surface and the side inner surface, respectively, of the mixing drum;

the side paddle comprises a parallel paddle portion carried by the transverse paddle arm and a perpendicular paddle portion carried by the parallel paddle portion, the parallel paddle portion generally parallel to the side inner surface and the perpendicular paddle portion generally perpendicular to the side inner surface;

at least one motor drivingly engaging the drive axle of the paddle assembly for rotation in the drum interior of the mixing drum;

a control portion on the support member, the control portion enabling control of the at least one motor; and a guard assembly including an arc and a chute hopper carried by open drum end of the mixing drum, the chute hopper and the arc each forming a corresponding half of a ring rotatable with respect to the mixing drum.

18. The apparatus of claim 17 further comprising at least one lifting device carried by the support member, the at least one lifting device configured to engage a support surface and selectively raise and lower the support member on the support surface.

19. The apparatus of claim 17 wherein the arc comprises a pair of handles for adjustable positioning of the guard assembly.

* * * * *